US008657251B2

(12) United States Patent
Kamimae

(10) Patent No.: US 8,657,251 B2
(45) Date of Patent: Feb. 25, 2014

(54) CAB SUPPORTING APPARATUS OF WORK MACHINE

(75) Inventor: Takeshi Kamimae, Hirakata (JP)

(73) Assignee: Komatsu Ltd. (JP)

( * ) Notice: Subject to any disclaimer, the term of this patent is extended or adjusted under 35 U.S.C. 154(b) by 485 days.

(21) Appl. No.: 12/442,736

(22) PCT Filed: Nov. 29, 2007

(86) PCT No.: PCT/JP2007/073043

§ 371 (c)(1),
(2), (4) Date: Mar. 25, 2009

(87) PCT Pub. No.: WO2008/069091

PCT Pub. Date: Jun. 12, 2008

(65) Prior Publication Data

US 2009/0314911 A1 Dec. 24, 2009

(30) Foreign Application Priority Data

Nov. 30, 2006 (JP) ..... 2006-323704
Apr. 26, 2007 (JP) ..... 2007-117355

(51) Int. Cl.

| | |
|---|---|
| ***F16M 1/00*** | (2006.01) |
| ***F16M 3/00*** | (2006.01) |
| ***F16M 5/00*** | (2006.01) |
| ***B60J 7/00*** | (2006.01) |
| ***B60K 37/00*** | (2006.01) |
| ***B60N 2/00*** | (2006.01) |
| ***B62D 33/00*** | (2006.01) |

(52) U.S. Cl.

USPC ..... 248/638; 248/678; 248/637; 248/636; 248/503; 248/503.1; 248/674; 248/562; 296/1.03; 296/190.01; 296/190.04; 296/190.07; 296/190.06; 180/89.13; 180/89.12

(58) Field of Classification Search

USPC ..... 248/638, 677, 678, 637, 636, 680, 503, 248/503.1, 506, 674, 562, 658; 296/1.03, 296/190.01, 190.04, 190.06, 190.07; 180/89.13, 89.12

See application file for complete search history.

(56) References Cited

U.S. PATENT DOCUMENTS

| | | | | |
|---|---|---|---|---|
| 2,323,153 | A * | 6/1943 | Pilson | 248/672 |
| 3,940,177 | A | 2/1976 | Miers et al. | |
| 4,766,587 | A * | 8/1988 | Dons et al. | 720/698 |
| 5,439,120 | A * | 8/1995 | Brozak | 211/59.1 |
| 5,790,372 | A * | 8/1998 | Dewey et al. | 361/679.58 |
| 5,796,593 | A * | 8/1998 | Mills et al. | 361/801 |
| 5,915,777 | A * | 6/1999 | Gignac et al. | 296/37.16 |
| 5,984,036 | A | 11/1999 | Higuchi et al. | |
| 6,557,816 | B2 * | 5/2003 | Yoshida | 248/674 |
| 6,648,295 | B2 * | 11/2003 | Herren et al. | 248/636 |
| 2003/0071187 | A1 * | 4/2003 | Herren et al. | 248/638 |
| 2006/0071499 | A1 | 4/2006 | Yoon | |
| 2006/0197364 | A1 * | 9/2006 | Bendure et al. | 297/256.12 |
| 2006/0220411 | A1 * | 10/2006 | Pathak et al. | 296/65.11 |
| 2009/0206626 | A1 * | 8/2009 | Bedard | 296/66 |

FOREIGN PATENT DOCUMENTS

| | | | |
|---|---|---|---|
| FR | 2281261 | A1 | 3/1976 |
| JP | 2-81284 | | 6/1900 |
| JP | 62-227879 | A | 10/1987 |
| JP | 05098666 | | 4/1993 |
| JP | 05125745 | | 5/1993 |
| JP | 08-226487 | | 9/1996 |
| JP | 2001-039354 | | 2/2001 |
| JP | 2002-013164 | A | 1/2002 |
| JP | 2002-138512 | A | 5/2002 |
| JP | 2004-189089 | A | 7/2004 |
| JP | 2005-330700 | | 12/2005 |
| JP | 2006-183693 | | 7/2006 |
| JP | 2007-162234 | A | 6/2007 |

OTHER PUBLICATIONS

International Preliminary Report on Patentability, dated Jun. 3, 2009, for related International Application No. PCT/JP2007/073043.

Japanese Notice of Allowance dated Jun. 19, 2012 for corresponding patent application No. 2008-548244.

Search Report dated Jul. 31, 2012, for corresponding French patent Application No. 0759446.

* cited by examiner

*Primary Examiner* — Terrell McKinnon
*Assistant Examiner* — Christopher Garft
(74) *Attorney, Agent, or Firm* — Fox Rothschild LLP

(57) ABSTRACT

A cab frame (14) is supported on brackets (12, 13) provided at a plurality of positions of a vehicle body frame (11) with dampers (15). Movement limiting mechanisms (30) for limiting a movement at least in a vertical direction of the cab frame (14) are provided between the brackets (12, 13) and the cab frame (14). Further, the movement limiting mechanisms (30) are provided at least at two positions. Each movement limiting mechanism (30) includes a lower limiting portion (31) arranged close to the brackets (12, 13) and constituted by a plate member, and an upper limiting portion (32) arranged close to the cab frame (14) and constituted by a plate member in the same manner. The lower limiting portion (31) is integrally structured with the brackets (12, 13). Recesses (33, 34) are formed in a side edge of at least one of the lower limiting portion (31) and the upper limiting portion (32), and the limiting portion in the other limiting portion is positioned within the recesses (33, 34). Accordingly, in the cab supporting apparatus of a work machine, the movement limiting mechanism (30) is arranged by using the brackets (12, 13) for supporting the cab frame (14). Therefore, it is possible to simplify the structure of the cab supporting apparatus by reducing the number of the parts, and it is possible to make the structure compact. Accordingly, even in a compact work machine, the cab supporting apparatus is easily mounted.

9 Claims, 20 Drawing Sheets

124
128
160
160
S5
151b
151a
152b
152
S4
S6
143
132
151c
151
151d
131
125
143
152a
122
126a 152a
152
S7
151
S5
151c
151b
152b

CAB SUPPORTING APPARATUS OF WORK MACHINE

FIELD OF THE INVENTION

The present invention relates to an operator's cab supporting apparatus of a work machine for supporting a cab frame on a vehicle body frame, in the work machine, for example, a crawler dozer.

BACKGROUND OF THE INVENTION

Generally, in the work machine such as the crawler dozer, a bracket is fixed at a plurality of positions on a vehicle body frame, and a cab frame is supported on the bracket. A damper is interposed between each of the brackets and the cab frame, and a vibration and an impact transmitted to the cab frame are damped by the damper. In each of the dampers, there is installed a movement limiting mechanism for limiting a movement of the cab frame in a vertical direction, a front-rear direction, and a lateral direction. Further, when a great load is applied to the cab frame from the outside in the case that the work machine rolls over by any chance, the movement of the cab frame in the vertical direction or the like is limited within a predetermined range by the movement limiting mechanism.

However, in the cab supporting apparatus having the structure mentioned above, since the movement limiting mechanism is installed in each of the dampers as mentioned above, the structure of the damper is complicated, and each of the dampers is enlarged in size, so that a cost required for installing the cab supporting apparatus is significantly increased.

In view of the problem mentioned above, there has been conventionally proposed a cab supporting apparatus of a work machine in which a damper and a movement limiting mechanism are arranged at different positions.

In this conventional cab supporting apparatus, since the movement limiting mechanism is provided independently from the damper, it is possible to achieve a downsizing of a damper and a simplification of an internal structure thereof. However, since the damper and the movement limiting mechanism are independent, brackets therefor may be provided independently. In such a case, the structure of the entire cab supporting apparatus becomes complicated, and a wide installing space for the cab supporting apparatus is required.

For the purpose of simplifying the structure of the cab supporting apparatus, a cab supporting apparatus is proposed in Patent Document 1. In the cab supporting apparatus of Patent Document 1, a cab frame is supported to a vehicle body frame with a damper. Further, as shown in FIG. 21, a movement limiting mechanism 103 for limiting a movement in a vertical direction or the like of a cab frame 102 is provided between a bracket 101 at one position on a vehicle body frame 109 and the cab frame 102 so as to be adjacent to a damper 104. This movement limiting mechanism 103 is provided with a shaft member 105 protruded on a lower surface of the cab frame 102, a cylindrical spacer 106 outside fitted to the shaft member 105, a stopper 107 fixed to a lower end of the spacer 106, and a supporting plate 108 arranged in a side of the bracket 101 in correspondence to the stopper 107.

Further, in the case that the cab frame 102 is moved in a direction away from the vehicle body frame 109, that is, upward in FIG. 14, the stopper 107 is brought into contact with the supporting plate 108, whereby the movement to the upper portion of the cab frame 102 is limited within a predetermined range. In contrast, in the case that the cab frame 102 is moved in a direction toward the vehicle body frame 109, that is, downward in FIG. 21, a bottom plate lower surface of the cab frame 102 is brought into contact with the upper surface of the damper 104, whereby the downward movement of the cab frame 102 is limited within a predetermined range.

Patent Document 1: Japanese Laid-Open Patent Publication No. 2004-189089

DISCLOSURE OF THE INVENTION

However, in the conventional cab supporting apparatus described in Patent Document 1, the movement limiting mechanism includes a plurality of members such as the shaft member 105, the spacer 106, the stopper 107, the supporting plate 108 and the like in addition to the bracket 101. Accordingly, the number of the parts is increased, the structure of the movement limiting mechanism is complicated, and there is a problem that it takes a lot of trouble with assembling and dismounting.

The present invention was made for solving the above problems in the prior art. An objective of the present invention is to provide a cab supporting apparatus of a work machine which limits a movement of a cab frame by using a bracket for supporting a cab frame, and simplifies the structure.

In order to achieve the objective mentioned above, and in accordance with the invention, a cab frame is supported on brackets provided at a plurality of positions of a vehicle body frame with vibration proofing mount means, and limiting means for limiting a movement at least in a vertical direction of the cab frame is provided between the bracket and the cab frame. Further, the limiting means is provided at least at two positions, the limiting means includes a lower limiting portion close to the bracket, and an upper limiting portion close to the cab frame, and the lower limiting portion is integrally structured with the bracket. The structure in which the lower limiting portion is integrated with the bracket includes a structure in which the lower limiting portion is fixed by welding, and fixed by a bolt or the like, in addition to the structure in which the lower limiting portion is integrated with the bracket.

Accordingly, in the cab supporting apparatus, the limiting means can be arranged by using a bracket for supporting the cab frame. Therefore, it is possible to make the structure of the cab supporting apparatus compact, and it is possible to simplify the structure of the cab supporting apparatus by reducing the number of the parts.

In the structure mentioned above, it is preferable to form a recess in a side edge of at least one of the lower limiting portion and the upper limiting portion, whereby the limiting portion in the opposition side is positioned within the recess.

In the structure mentioned above, if the structure is made such that at least one of the lower limiting portion and the upper limiting portion forms a hook portion in a distal end thereof, and the hook portion limits the movement of the cab frame, it is possible to reliably regulate the position of the cab frame in the hook portion.

In the structure mentioned above, if an upper end of the bracket includes a plate member, and the lower limiting portion is integrally formed in the plate member, the limiting means is simply structured only by forming the plate member in accordance with a cutting work, for example, by a plasma arc cutting machine.

In the structure mentioned above, if a plate member is fixed to a bottom surface of the cab frame, and the upper limiting portion is integrally formed in the plate member, the limiting means is simply structured only by forming the plate member in accordance with a cutting work, for example, by a plasma arc cutting machine, in the same manner as mentioned above.

Further, in the structure mentioned above, a lower portion is provided in a front portion of a floor portion of the cab frame, a higher portion is provided in a rear portion, and the vibration proofing mount means is interposed between the bracket, and the lower portion and the higher portion of the floor portion. Further, in the limiting means between the vehicle body frame and both right and left end portions in the lower portion of the cab frame, the limitation in the moving range of the cab frame is cancelled at least in one direction other than the vertical direction.

Further, when the work machine, for example, rolls over, an excessive load is applied at a high sharing rate to the rear portion of the cab frame. On the other hand, since the excessive load is applied only at a low sharing rate to the front portion of the cab frame, the excessive load can be borne even if the limitation of the moving range is cancelled. Accordingly, it is possible to simplify the structure as a whole of the cab supporting apparatus, and it is possible to reduce the manufacturing costs.

BRIEF DESCRIPTION OF THE DRAWINGS

FIG. 18(*b*) is a cross-sectional plan view showing first and second limiting plates;

DETAILED DESCRIPTION OF THE INVENTION

Figure 1:
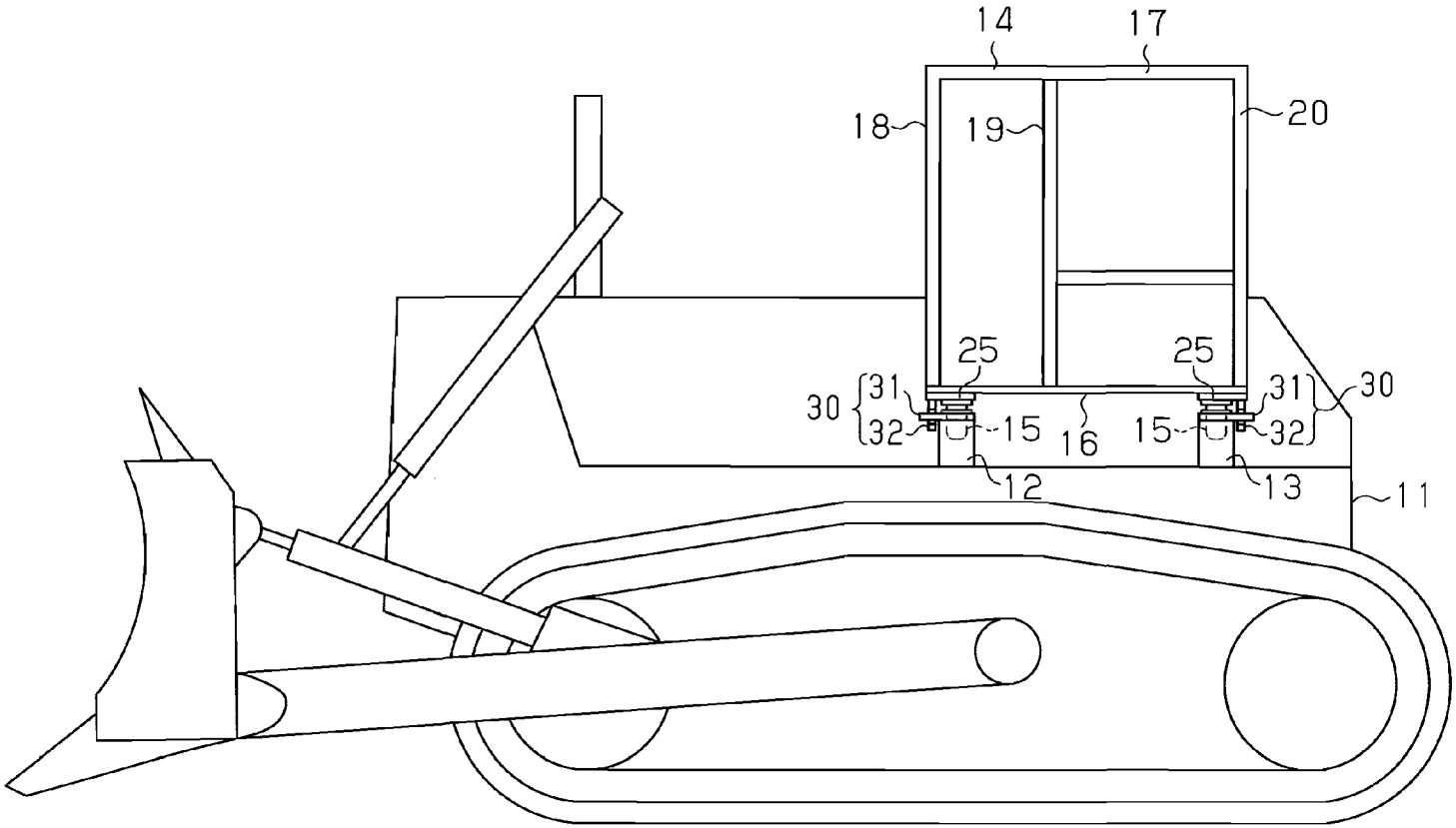
FIG. 1 is a side view showing a work machine provided with a cab supporting apparatus of work machine in accordance with a first embodiment.

A description will be given of work machines according to embodiments of the invention. In the present embodiment, the work machines are crawler dozers.

First Embodiment

First, a description will be given of a first embodiment with reference to FIGS. 1 to 9.

As shown in FIGS. 1 to 3 and 5, in a crawler dozer in accordance with the first embodiment, pairs of right and left metal brackets 12 and 13 are fixed at four positions on a vehicle body frame 11 so as to be spaced from each other in such a manner as to correspond to four corners of a bottom portion of a cab frame 14.

As shown in FIGS. 1 to 4, a cab frame 14 is supported on each of the brackets 12 and 13 with a damper 15 serving as vibration proofing mount means. The cab frame 14 is provided with a floor portion 16 and a ceiling portion 17. Right and left front pillars 18, intermediate pillars 19 and rear pillars 20 are arranged between the floor portion 16 and the ceiling portion 17 of the cab frame 14. Each of the brackets 12 and 13 and the dampers 15 are positioned immediately below the front pillars 18 and the rear pillars 20.

Figure 4:
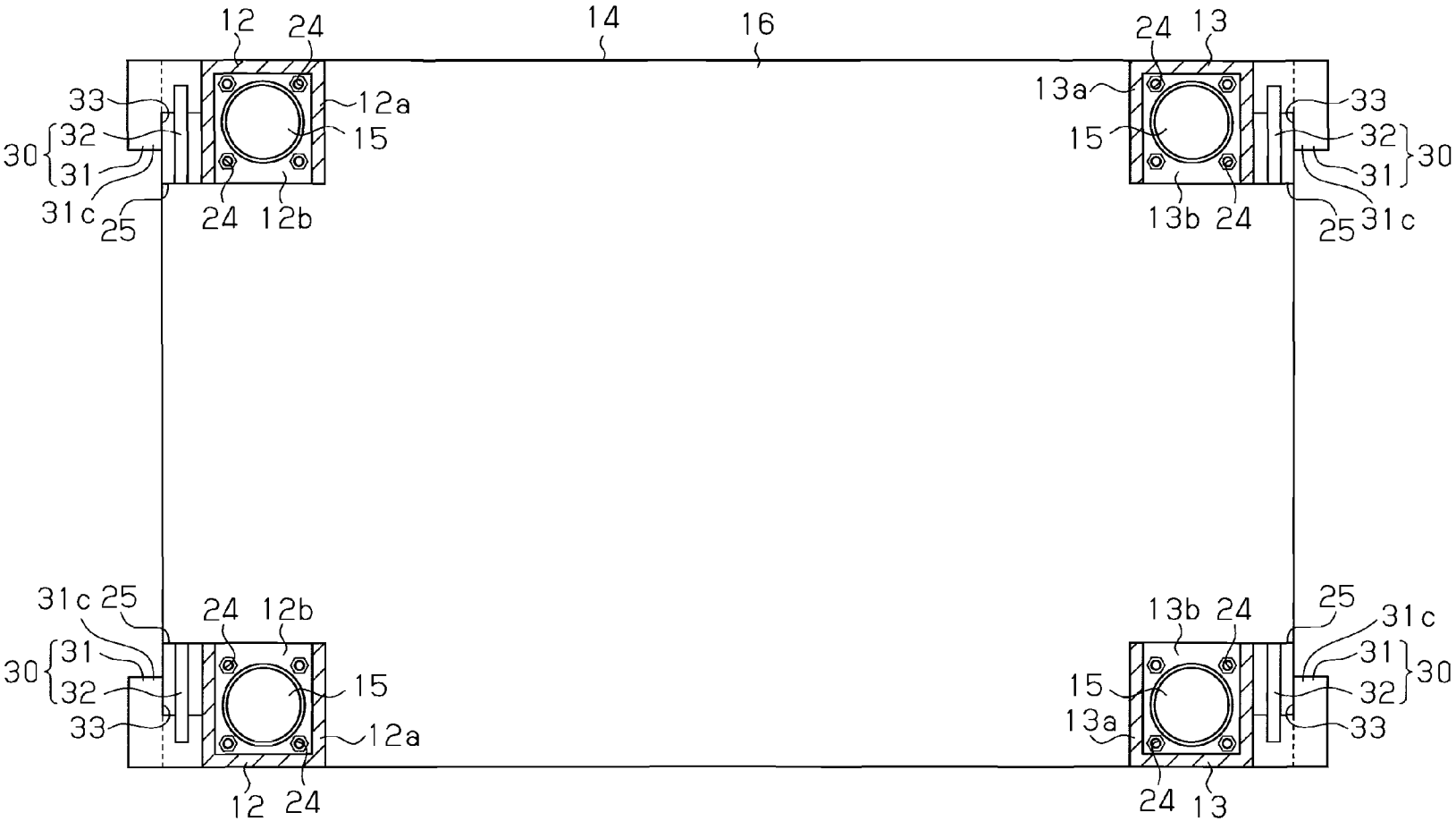
FIG. 4 is an enlarged cross-sectional view taken along line 4-4 in FIG. 2.
Figure 5:
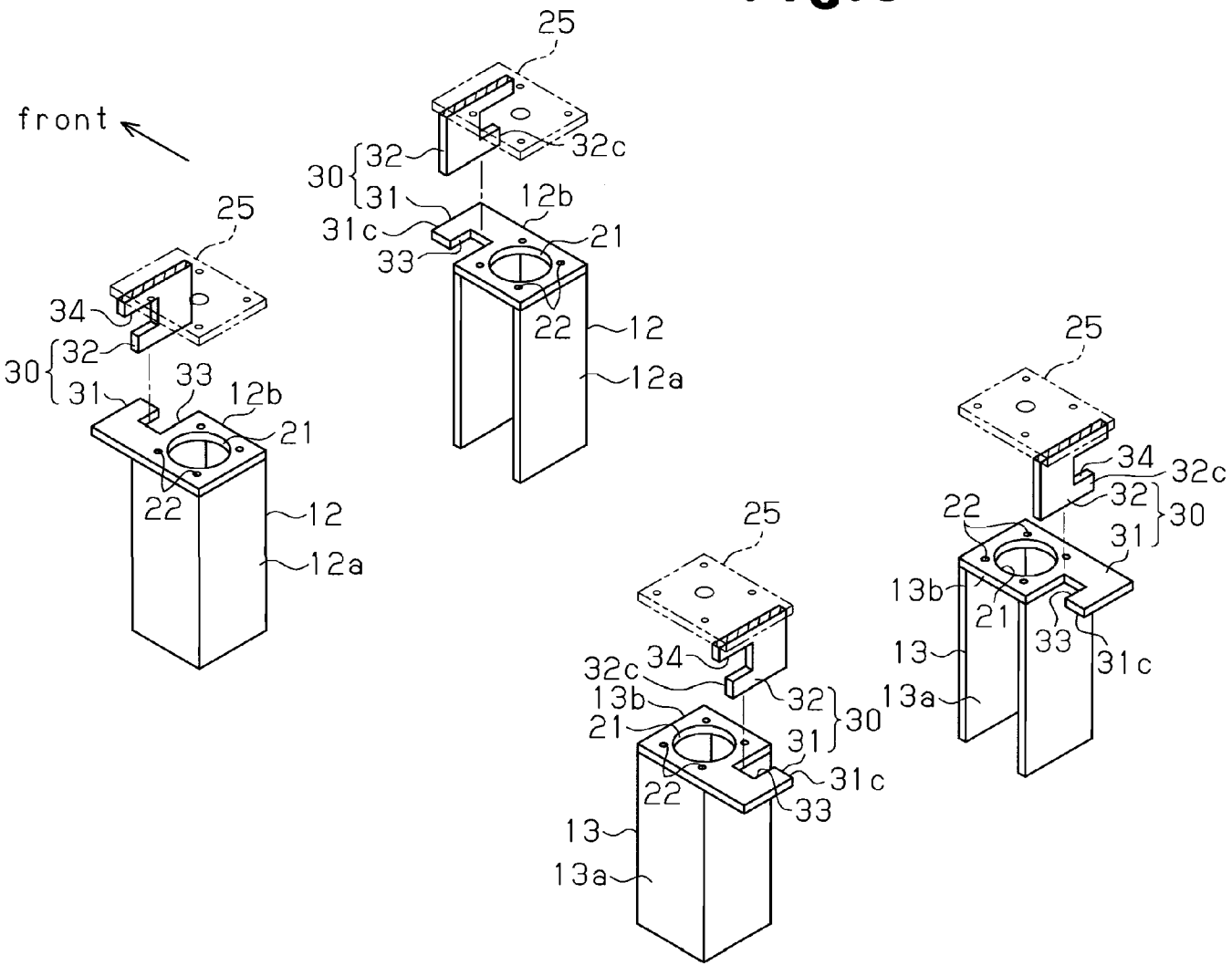
FIG. 5 is an exploded perspective view showing a movement limiting mechanism in the cab supporting apparatus in FIG. 1.

As shown in FIGS. 4 and 5, the brackets 12 and 13 are respectively constituted by support posts 12*a* and 13*a* having a channel shaped horizontal cross-sectional shape, and lower plates 12*b* and 13*b* corresponding to plate members fixed to upper ends of the support posts 12*a* and 13*a* by welding in such a manner as to be positioned within a horizontal plane. A through hole 21 is formed in the lower plates 12*b* and 13*b*. A plurality of bolt insertion holes 22 are formed in the lower plates 12*b* and 13*b* of the respective brackets 12 and 13 in such a manner as to be positioned around the through hole 21.

Figure 6:
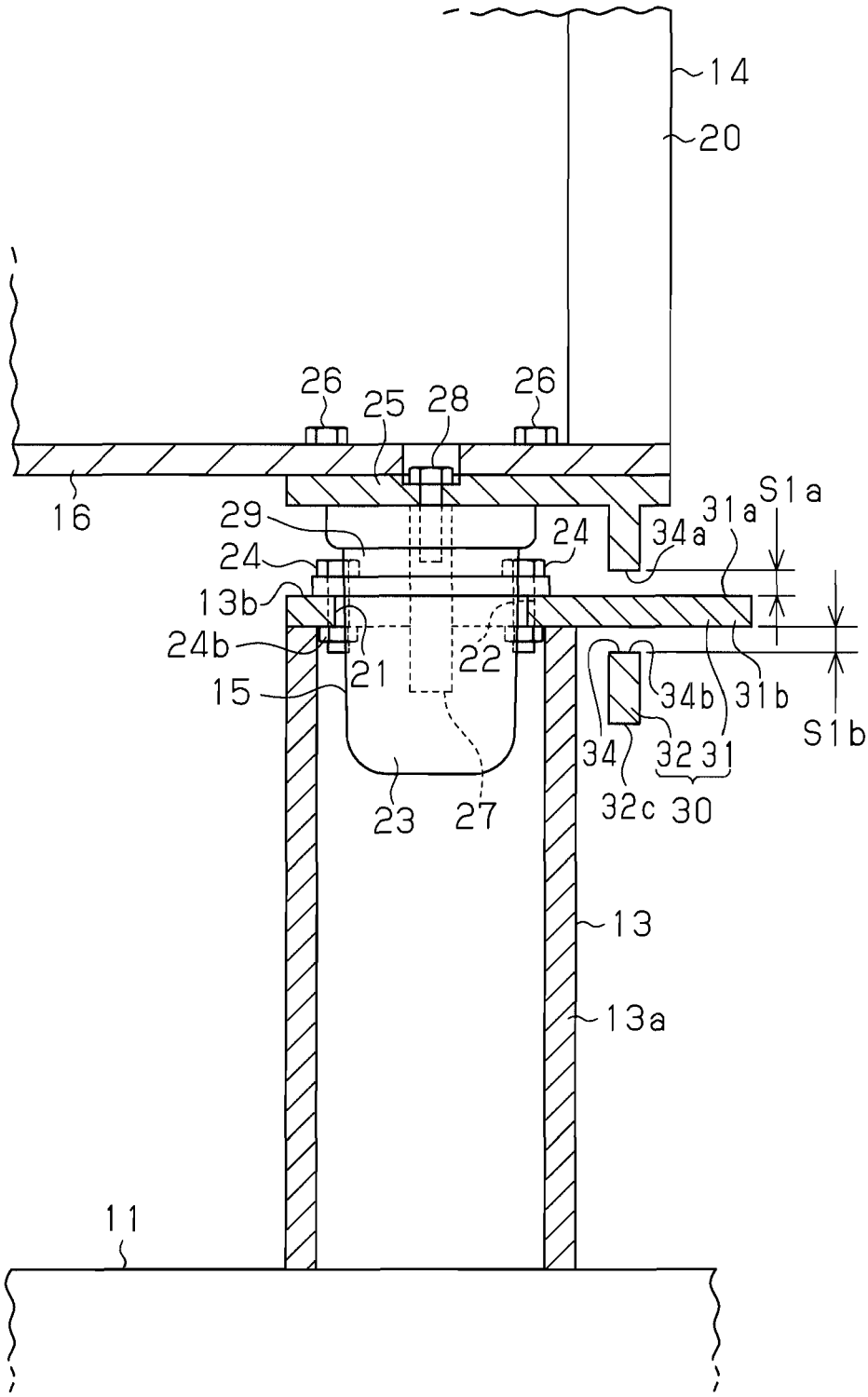
FIG. 6 is a partly enlarged cross-sectional view taken along line 6-6 in FIG. 3.

As shown in FIG. 6, each of the dampers 15 is provided with a closed-end cylindrical case 23 filled with a damping fluid (not shown) based on silicone oil or the like. The case 23 is fixed to the lower plates 12*b* and 13*b* of the brackets 12 and 13 by a bolt 24 extending through each of the bolt insertion holes 22 and a nut 24*b*, in a state of being inserted to the through holes 21 of the brackets 12 and 13.

A plurality of upper plates 25 corresponding to metal plate members are fixed to a lower surface of the floor portion 16 of the cab frame 14 by a plurality of bolts 26 and nuts (not shown) in such a manner as to correspond to each of the brackets 12 and 13. A stud 27 is fixed to a lower surface of each of the upper plates 25 by a bolt 28. A damping member 29 made of an elastic material such as a rubber or the like is interposed between the stud 27 and the case 23, and the damping member 29 closes an upper end opening of the case 23. Although not illustrated, a valve body, which is positioned in the damping fluid within the case 23 of the damper 15, is fixed to a lower end portion of the stud 27. Further, a spring (not shown) is interposed between the valve body and an inner bottom surface of the case 23, and the cab frame 14 is urged upward with the stud 27 by this spring.

Further, in the case that a vibration or an impact is applied to the vehicle body frame 11 at a time when the crawler dozer travels or the like, the stud 27 of each of the dampers 15 is relatively moved in a vertical direction, a front-rear direction and a lateral direction with respect to the case 23. On the basis of relative movement, the damping member 29 and the spring are elastically deformed, and the valve body is moved in the damping fluid, whereby a fluid resistance is generated in an orifice within the damping fluid. Further, the vibration and the impact transmitted to the cab frame 14 are damped and reduced on the basis of a cooperation of an elastic deformation and a fluid resistance.

Figure 2:
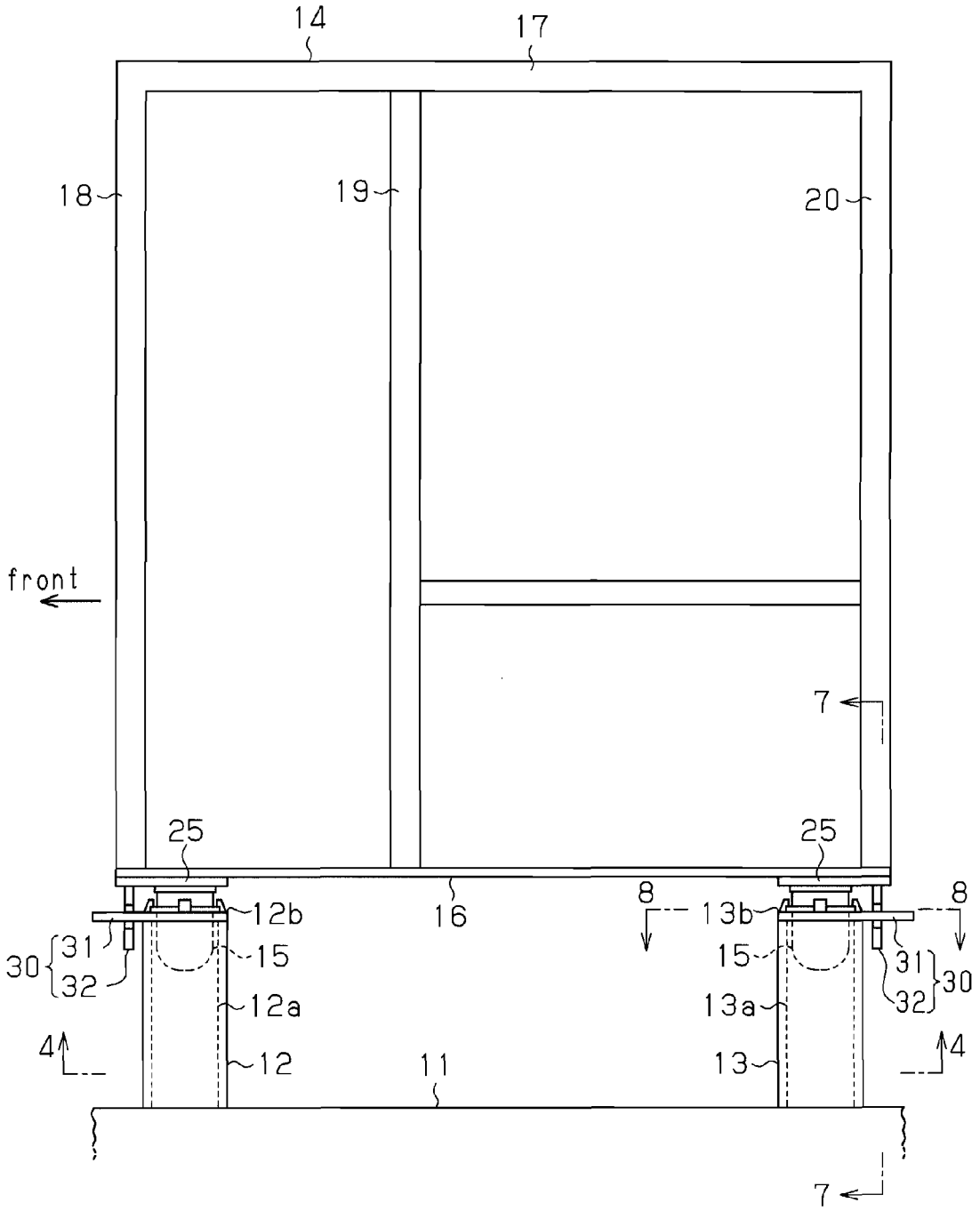
FIG. 2 is an enlarged side view showing the cab supporting apparatus in the work machine in FIG. 1.
Figure 3:
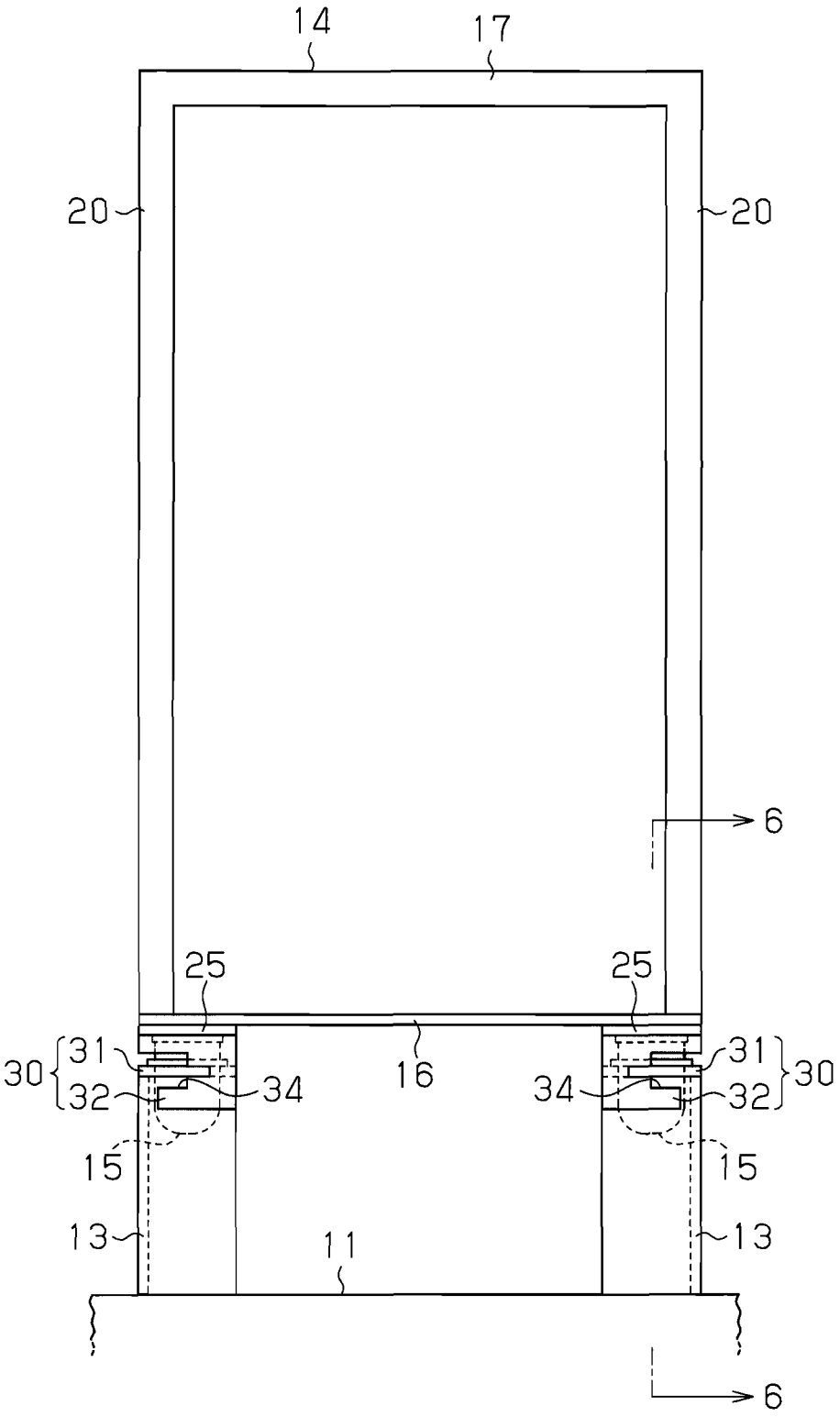
FIG. 3 is a rearview of the cab supporting apparatus.

As shown in FIGS. 1 to 3, a plurality of movement limiting mechanisms 30 corresponding to limiting means are respectively provided between each of the brackets 12 and 13 and the cab frame 14. Further, when a great load is applied to the cab frame 14 from the outside, in the case that the crawler dozer rolls over by any chance or the like, the movement in the vertical direction, the front-rear direction and the lateral direction of the cab frame 14 is limited by the movement limiting mechanism 30 within a predetermined range.

Accordingly, a description will be given in detail of the structure of the movement limiting mechanism 30.

Figure 7:
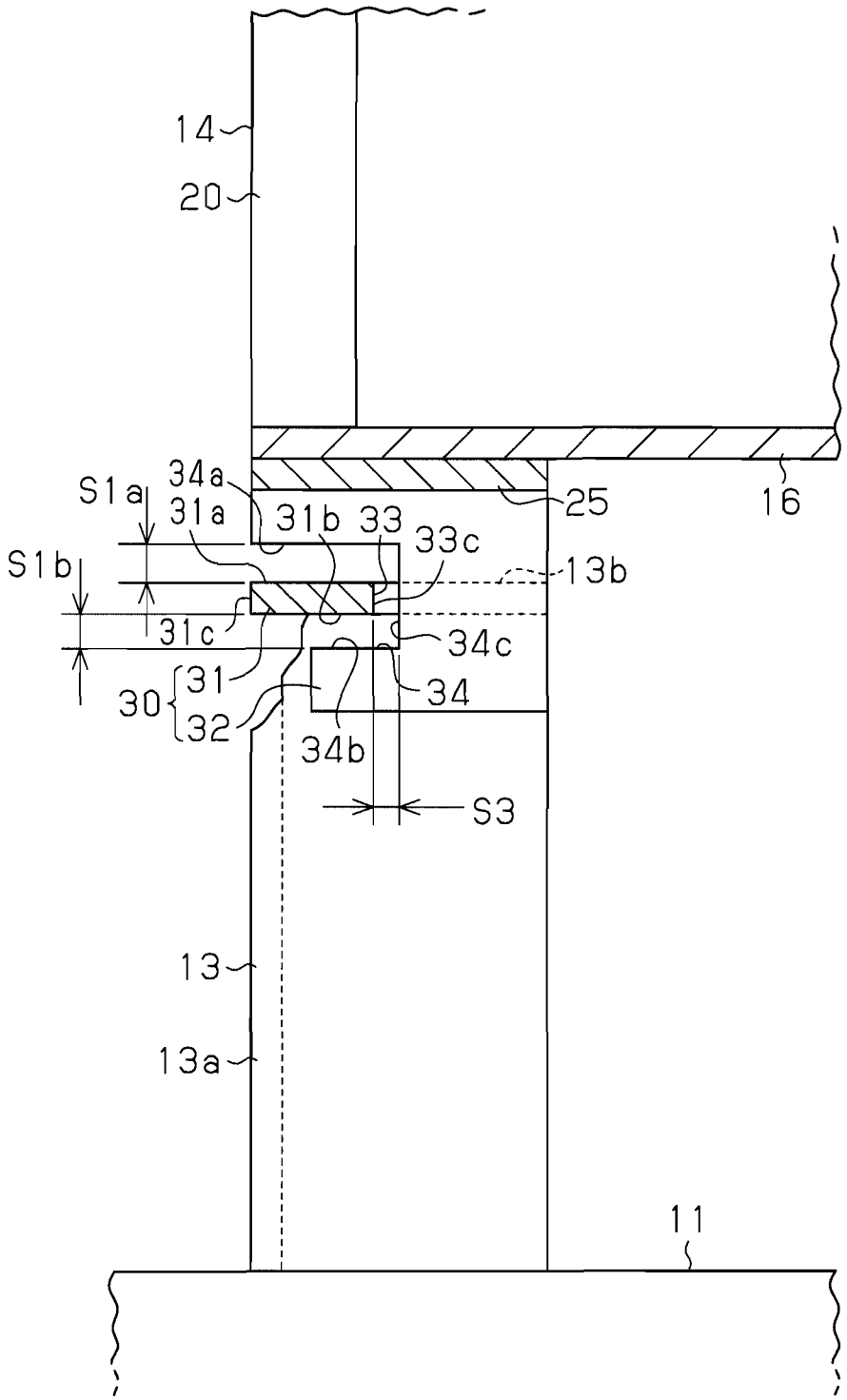
FIG. 7 is a partly enlarged cross-sectional view taken along line 7-7 in FIG. 2.

As shown in FIGS. 5 to 7, each of the movement limiting mechanism 30 includes a lower limiting portion 31 close to the brackets 12 and 13, and an upper limiting portion 32 close to the cab frame 14. The lower limiting portion 31 is integrally formed so as to protrude forward or rearward from a front end or a rear end of the lower plates 12*b* and 13*b* of the respective brackets 12 and 13. The upper limiting portion 32 is integrally formed so as to protrude downward direction a front end or a rear end of each of the upper plates 25 fixed to the lower surface of the cab frame 14.

As shown in FIGS. 5 to 8, each of the lower limiting portions 31 forms a recess 33 inside, that is, a center in the lateral direction of the vehicle body frame 11, and an L-shaped hook portion 31*c* is formed in a distal end of each of the lower limiting portion 31 on the basis of the formation of the recess 33. Further, each of the upper limiting portions 32 forms a recess 34 on an outer side, that is, an outer side in the lateral direction of the vehicle body frame 11, and an L-shaped hook portion 32*c* is formed in a distal end of the upper limiting portion 32 on the basis of the formation of the recess 34. Further, in a state in which the recess 33 of each of the lower limiting portions 31 opposes to the recess 34 of each of the upper limiting portions 32, the lower limiting portion 31 and the upper limiting portion 32 are respectively positioned within the recess 34 and the recess 33, and the hook portions 31*c* and 32*c* respectively oppose to an outer surface of the upper limiting portion 32 and a lower surface of the lower limiting portion 31.

Further, as shown in FIGS. 6 and 7, a gap S1*a* is formed between an upper surface 31*a* of the lower limiting portion 31 and an upper edge portion 34*a* of the recess 34 of the upper limiting portion 32. Further, a gap S1*b* is formed between a lower surface 31*b* of the lower limiting portion 31 and a lower edge portion 34*b* of the recess 34 of the upper limiting portion 32. Accordingly, a movement in the vertical direction of the cab frame 14 is allowed with respect to the vehicle body frame 11, within the range of the gaps S1*a* and S1*b*.

Figure 8:
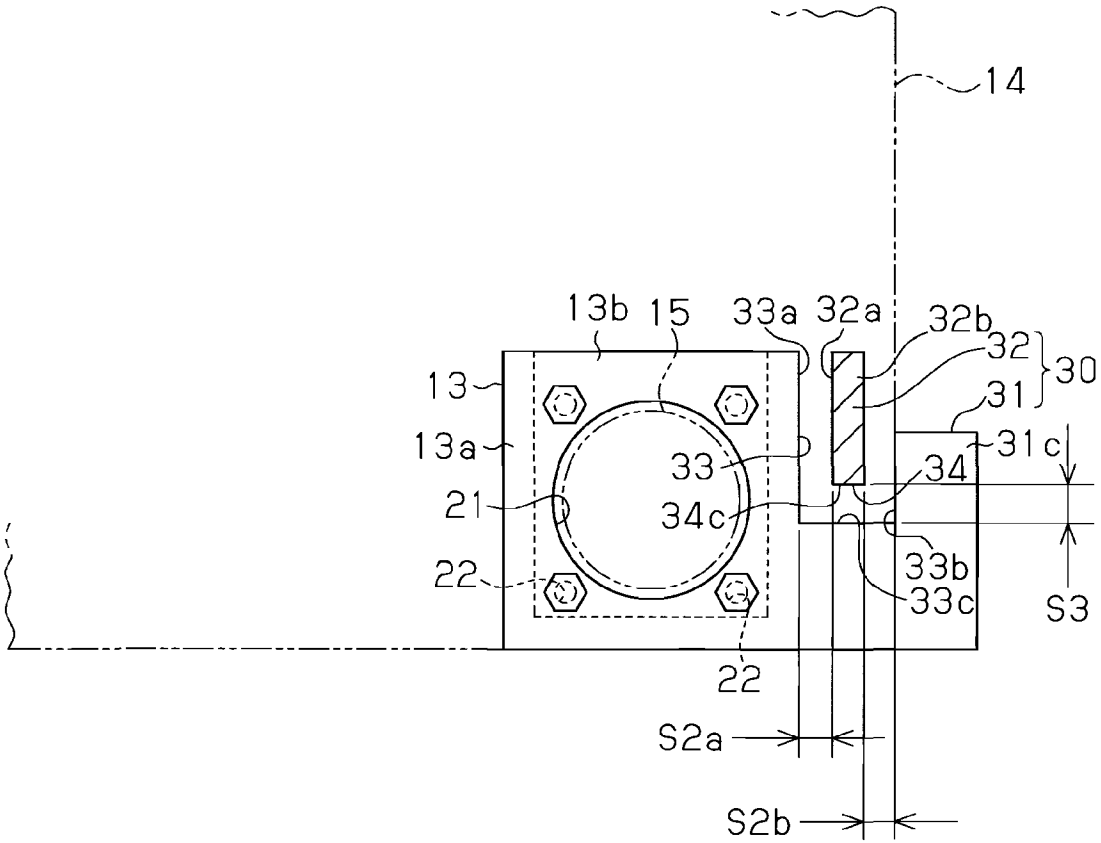
FIG. 8 is a partly enlarged cross-sectional view taken along line 8-8 in FIG. 2.
Figure 9A:
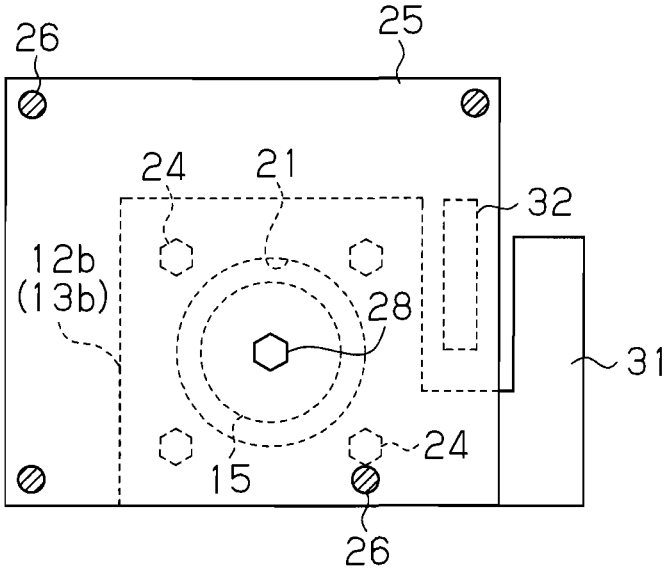
FIGS. 9(*a*) and 9(*b*) are partially plan views respectively showing a structure which allows a difference of a vehicle body frame.
Figure 9B:
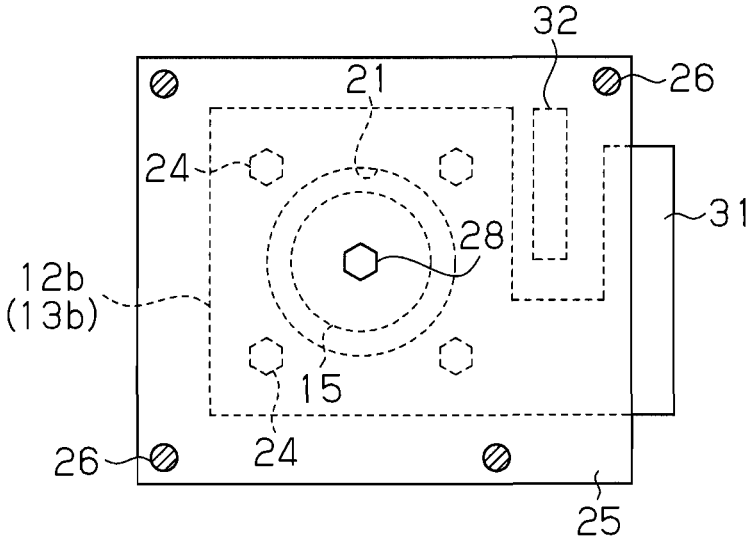

Further, as shown in FIG. 8, a gap S2*a* is formed between an inner surface 32*a* of the upper limiting portion 32 and an inner edge portion 33*a* of the recess 33 of the lower limiting portion 31. Further, a gap S2*b* is formed between an outer surface 32*b* of the upper limiting portion 32 and an inner edge portion 33*b* of the recess 33 of the lower limiting portion 31. Accordingly, a movement in the front-rear direction of the cab frame 14 is allowed with respect to the vehicle body frame 11, within the range of the gaps S2*a* and S2*b*.

Further, as shown in FIGS. 7 and 8, a gap S3 is formed between an innermost edge portion 33*c* of the recess 33 of the lower limiting portion 31 and an innermost edge portion 34*c* of the recess 34 of the upper limiting portion 32. Accordingly, a movement in the lateral direction of the cab frame 14 is allowed with respect to the vehicle body frame 11, within the range of the gap S3.

In other words, the cab frame 14 is prevented from moving on the basis of an engagement between the lower limiting portion 31 and the upper limiting portion 32 at a position where the cab frame 14 has been moved in the vertical, front-rear and lateral directions respectively at the gaps S1*a* and S1*b*, the gaps S2*a* and S2*b* and the gap S3 with respect to the vehicle body frame 11. Accordingly, the cab frame 14 is limited in the movement in the vertical, front-rear and lateral directions respectively within the ranges of the gaps S1*a* and S1*b*, the gaps S2*a* and S2*b* and the gap S3 with respect to the vehicle body frame 11. On the other hand, within the ranges of the above gaps, the damper 15 can suppress propagation of the vibrations or impact to the cab frame 14.

Next, a description will be given of an assembling method of the cab supporting apparatus in the crawler dozer structured as mentioned above.

In the cab supporting apparatus, in a state before the cab frame 14 is assembled with respect to the vehicle body frame 11, the stud 27, the damping member 29 and the like are in a state of being incorporated in the case 23 of each of the dampers 15. Further, the brackets 12 and 13 to which the lower plates 12*b* and 13*b* have been fixed by welding are previously fixed to four positions on the vehicle body frame 11.

Further, in the case that the cab frame 14 is supported onto the brackets 12 and 13, the case 23 of the damper 15 is first inserted to the through hole 21 on each of the brackets 12 and 13. In this state, the damper 15 is fixed to the lower plates 12*b* and 13*b* of the brackets 12 and 13 by the bolt 24 and the nut 24*b*.

Subsequently, the upper plate 25 is arranged on each of the dampers 15. At this time, the recess 34 of the upper limiting portion 32 in each of the upper plates 25 is opposed to the recess 33 in each of the lower limiting portions 31. Further, the recesses 34 and 33 of the upper limiting portion 32 and the lower limiting portion 31 are respectively positioned in such a manner that the gaps S1*a*, S1*b*, S2*a*, S2*b* and S3 are respectively created within the recesses 33 and 34 of the lower limiting portion 31 and the upper limiting portion 32. In this state, the upper plate 25 is fixed with respect to the stud 27 in each of the dampers 15 by the bolt 28.

Thereafter, four corners of the cab frame 14 are aligned with each of the upper plates 25. In this case, the cab frame 14 is set to a suspended state, whereby a weight of the cab frame 14 is not applied to each of the upper plates 25. In this state, each of the upper plates 25 is fixed to a lower surface of the floor portion 16 of the cab frame 14 by the bolt 24 from above the floor portion 16 of the cab frame 14. On the basis of this fixation, the cab frame 14 is supported on the brackets 12 and 13 close to the vehicle body frame 11 with the damper 15. In addition, the movement limiting mechanism 30 constituted by the lower limiting portion 31 and the upper limiting portion 32 is interposed at four positions immediately below the front pillars 18 and the rear pillars 20 of the cab frame 14 between each of the brackets 12 and 13 and the cab frame 14.

Even in different types of work machines, such as the crawler dozer, a hydraulic excavator or the like, the cab frame 14 is structured as one or two seaters, and the size and shape thereof are hardly changed. However, the size and shape in the vehicle body frame 11 vary in accordance with the type, the model or the like of the vehicle, and there is a case that the positions of the brackets 12 and 13 are forced to be changed in correspondence thereto. In order to cope with this, it is preferable to enlarge the upper plate 25, thereby making the attached positions of the upper limiting portion 32 and the damper 15 changeable, and appropriately setting the positions of the upper limiting portion 32 and the damper 15 in correspondence to the brackets 12 and 13, that is, the position of the lower limiting portion 31. In accordance with this structure, a position displacement of the brackets 12 and 13 on the basis of the difference in the type, the model or the like can by accommodated by using the same upper plate 25 to change the positions of the upper limiting portion 32 and the damper 15. Accordingly, a common specification of the cab frame 14 is achieved.

Next, a description will be given of an operation of the cab supporting apparatus in the crawler dozer structured as mentioned above.

At a traveling time, a working time or the like of the crawler dozer, vibrations and impact generated in the vehicle body frame 11 are reduced by each of the dampers 15. Accordingly, it is possible to improve riding comfort in the cab frame 14.

In contrast, when a great load is applied to the cab frame 14 from the outside and an excessive deformation is generated in the supporting portion of the cab frame 14, that is, the damper 15, in the case that the crawler dozer rolls over by any chance or the like, the great load is received by the engagement between the lower limiting portion 31 and the upper limiting portion 32 of each of the movement limiting mechanisms 30. In other words, in each of the movement limiting mechanisms 30, the lower limiting portion 31 and the upper limiting portion 32 are arranged so as to oppose to each other while interposing the gaps S1*a*, S1*b*, S2*a*, S2*b* and S3, as shown in FIGS. 6 to 8. Accordingly, the movement in the vertical direction of the cab frame 14 is limited with respect to the vehicle body frame 11, within the range of the gaps S1*a* and S1*b*. Further, the movement in the front-rear direction of the cab frame 14 is limited within the range of the gaps S2*a* and S2*b*. Further, the movement in the lateral direction of the cab frame 14 is limited within the range of the gap S3.

Accordingly, the cab frame 14 can bear the great load applied thereto, and can protect an operator within the cab. Each of the dampers 15 has a certain level of limiting function in the moving range in each of the vertical, front-rear and lateral directions. However, if such a limiting function as to withstand the great load in each of the directions is provided to the damper itself, the damper 15 is enlarged in dimension, and a problem in the incorporation, and a problem in the manufacturing cost are generated. In contrast, in this embodiment, since the movement limiting mechanism 30 takes charge of the limiting function, it is not necessary that the damper 15 has such a limiting function to withstand great load, and it is possible to employ a compact structure for the damper 15.

As mentioned above, in the cab supporting apparatus in the crawler dozer in accordance with the embodiment, the movement limiting mechanism 30 is used by the brackets 12 and 13 for supporting the cab frame 14. Accordingly, it is possible to prevent the number of the parts from being increased, and prevent a wide space from being required for installing the movement limiting mechanism 30. Therefore, it is possible to easily mount or dismount the movement limiting mechanism 30 even in a compact work machine, and it is possible to simplify the structure. Further, since the lower limiting portion 31 and the upper limiting portion 32 of the movement limiting mechanism 30 are constructed by a part of the plate member, the parts of the movement limiting mechanism 30 can be structured only by forming the plate members in accordance with a cutting work, for example, by a plasma arc cutting machine. Accordingly, it is possible to easily manufacture and assemble the movement limiting mechanism 30.

Second Embodiment

Next, a description will be given of a second embodiment in accordance with this invention.

In this case, in each of the second embodiment and the following embodiments and modified embodiments, a description will be given mainly of different portions from the first embodiment.

Figure 10:
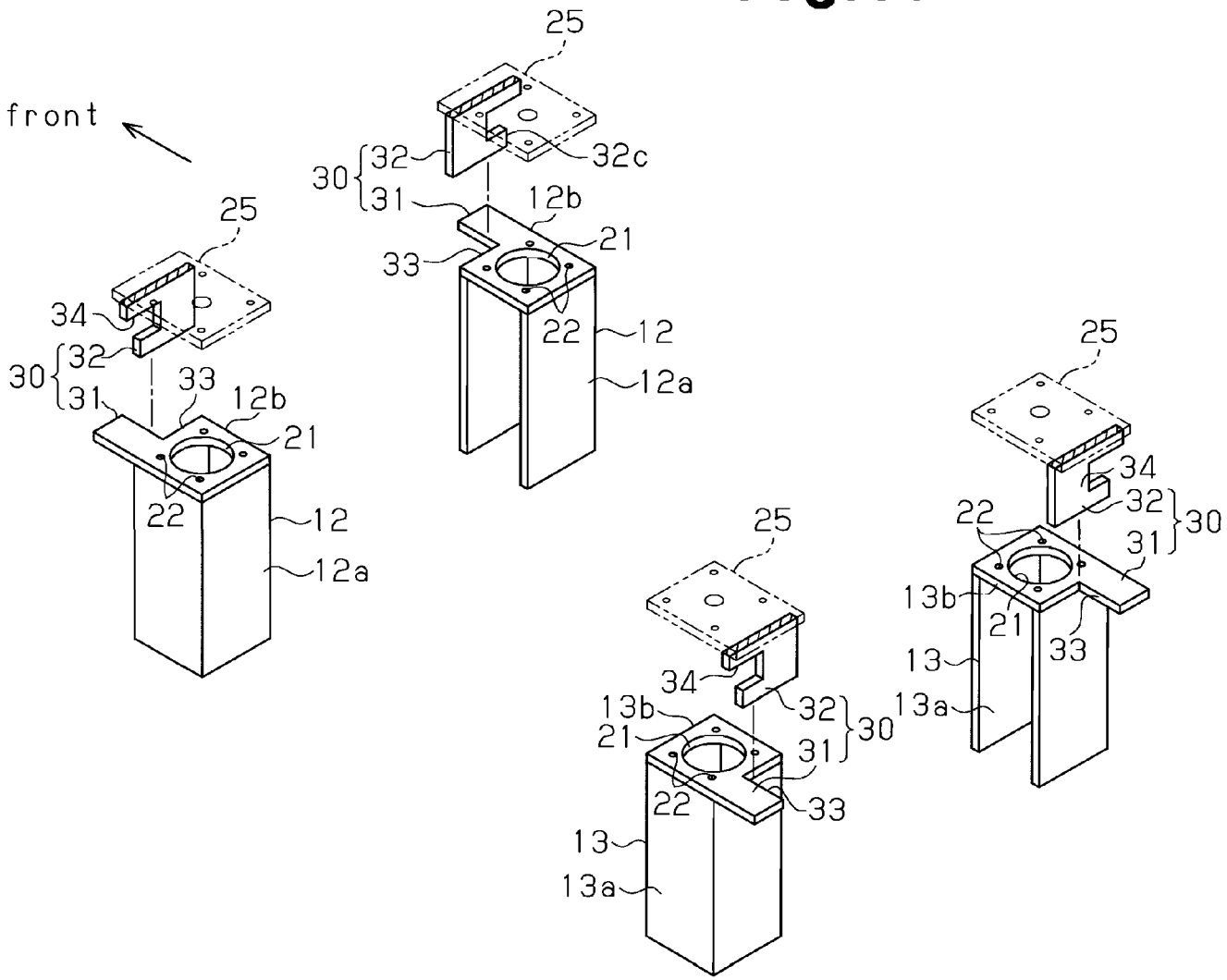
FIG. 10 is an exploded perspective view showing a movement limiting mechanism in a cab supporting apparatus in accordance with a second embodiment.

In the second embodiment, the structure is made such that the hook portion 32*c* is omitted in the lower limiting portions 31 in the front and the rear, as shown in FIG. 10. In other words, the lower limiting portion 31 has a recess 33 formed by a notch in a center in the lateral direction of the vehicle body frame in a front end or a rear end of the lower plates 12*b* and 13*b*. The upper limiting portion 32 corresponding to the lower limiting portion 31 has a recess 34 provided with a hook portion 32*c*. In accordance with this structure, the position of the cab frame 14 is limited in the vertical direction.

Since the hook portion 31*c* of the lower limiting portion 31 does not exist, it is possible facilitates the assembly of the upper limiting portion 32 with respect to the lower limiting portion 31.

Third Embodiment

Figure 11:
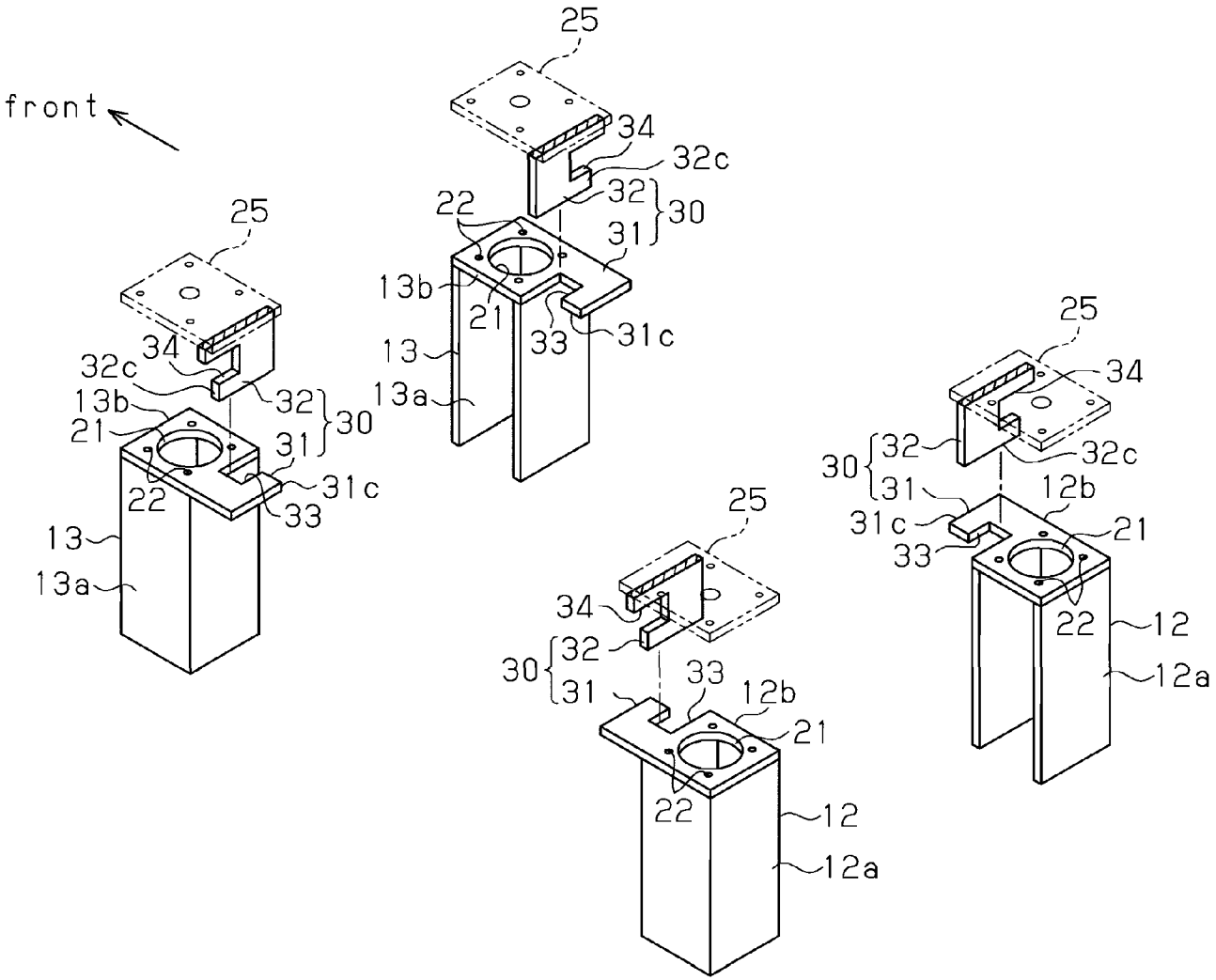
FIG. 11 is an exploded perspective view showing a movement limiting mechanism in a cab supporting apparatus in accordance with a third embodiment.

In a third embodiment, the structure is made such that a positional relation in the front and rear movement limiting mechanisms 30, that is, a protruding direction of the front and rear lower limiting portions 31 is inverted back to front in comparison with the first embodiment, as shown in FIG. 11.

In accordance with this structure, the same advantages as the first embodiment are obtained.

Fourth Embodiment

A fourth embodiment is suitable for a case that the cab supporting apparatus provided with the movement limiting mechanism 30 is mounted to the hydraulic excavator serving as the work machine.

Figure 12:
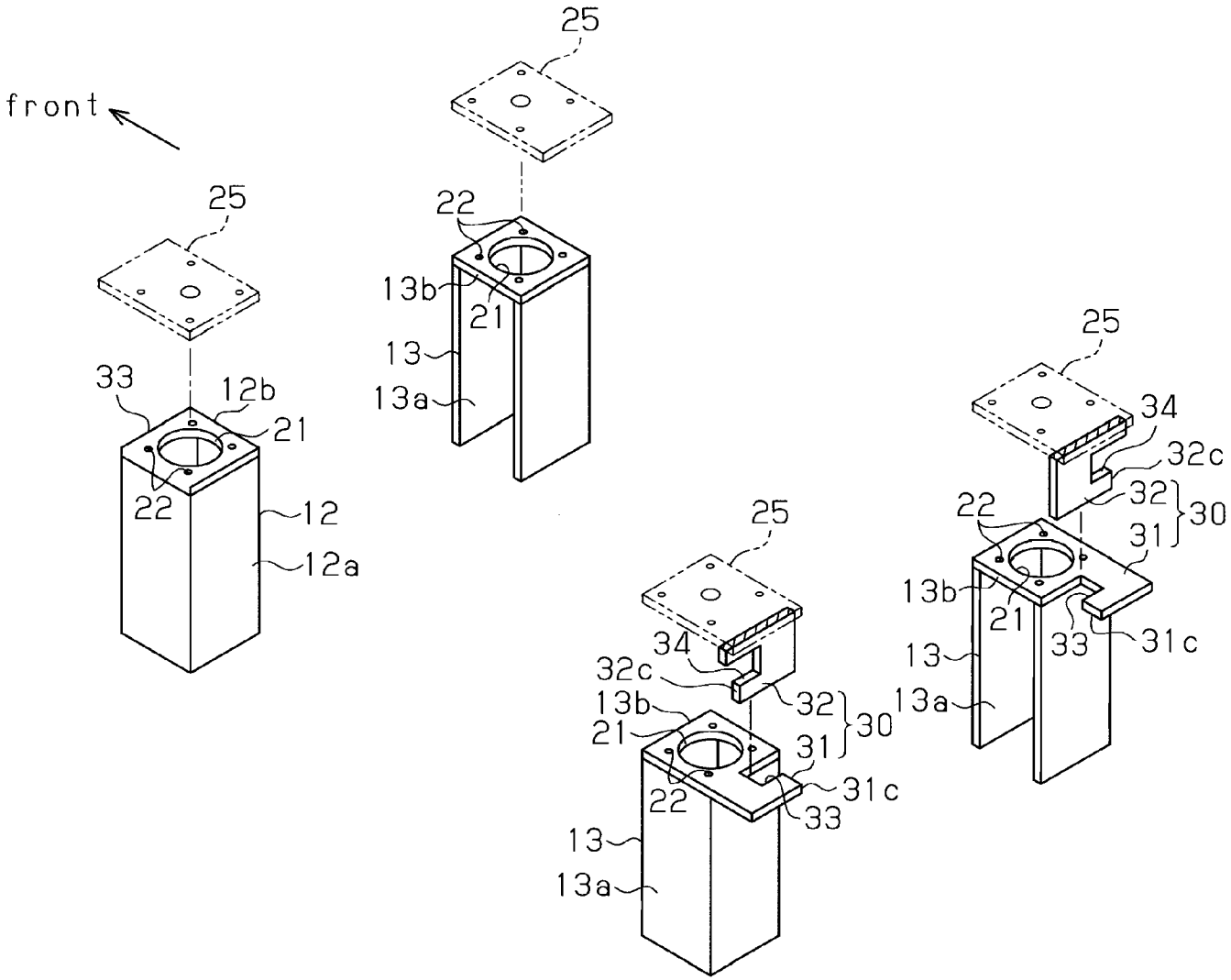
FIG. 12 is an exploded perspective view showing a movement limiting mechanism in a cab supporting apparatus of in accordance with a fourth embodiment.

In other words, in the fourth embodiment, the front movement limiting mechanism is omitted as shown in FIG. 12.

In this case, in the hydraulic excavator, the cab frame 14 is positioned from a front end in a left side or a right side of the vehicle body frame to a center portion, and a supporting shaft of a boom serving as an implement is arranged on the vehicle body frame in the right side or the left side of the cab frame 14. Further, in the hydraulic excavator, since the implement exists, the hydraulic excavator hardly rolls over forward of the vehicle body, and a possibility that the external force from the front is applied to the cab frame 14 is very low. Accordingly, no problem is generated even if the front movement limiting mechanism is omitted.

Fifth Embodiment

Figure 13:
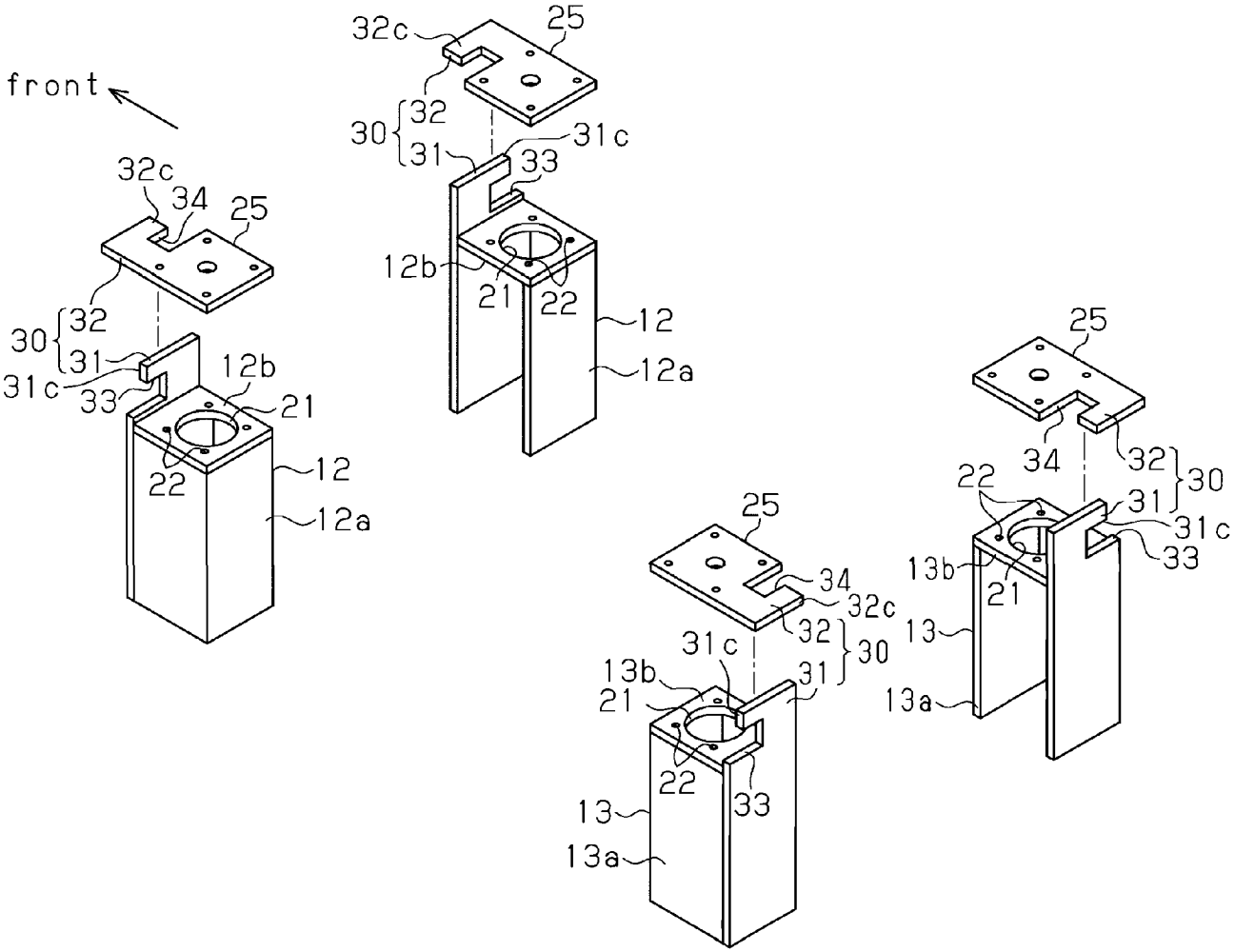
FIG. 13 is an exploded perspective view showing a movement limiting mechanism in a cab supporting apparatus of in accordance with a fifth embodiment.

In a fifth embodiment, as shown in FIG. 13, the lower limiting portion 31 of each of the movement limiting mechanism 30 is integrally formed with side plates of the support posts 12*a* and 13*a* in such a manner as to protrude upward in a front portion or a rear portion of the support posts 12*a* and 13*a* of the brackets 12 and 13. A recess 33 with a hook portion is formed in an outer side in the lateral direction of each of the lower limiting portions 31. In contrast, the upper limiting portion 32 of each of the movement limiting mechanisms 30 is integrally formed in such a manner as to protrude forward or rearward in a front end or a rear end of the upper plate 25. Further, a recess 34 is formed in an inner side of each of the upper limiting portions 32. Further, a positional relation between the recess 33 of each of the lower limiting portions 31 and the recess 34 of each of the upper limiting portions 32 is upside down with respect to the positional relation between the lower limiting portion 31 and the upper limiting portion 32 in accordance with the first embodiment.

Accordingly, in the fifth embodiment, the same advantages as the first embodiment can be obtained.

Sixth Embodiment

Next, a description will be given of a sixth embodiment in accordance with this invention with reference to FIGS. 14 to 19.

The sixth embodiment is structured such that the cab frame forms a height difference in the front-rear direction in the floor portion, and of a rear high mount type in which a higher portion is formed in a rear portion of the floor portion. In the work machine such as the crawler dozer or the like provided with this kind of cab frame, the following fact has been discovered recently. The sixth embodiment was made on the basis of this fact. That is, in the rear high mount type work machine, it has been discovered that in the case that an excessive load is applied to the cab frame at a time of rolling over or the like, most of the load is applied to the rear portion of the cab frame, and a sharing rate of the front portion with respect to the maximum load is not so high.

Figure 14:
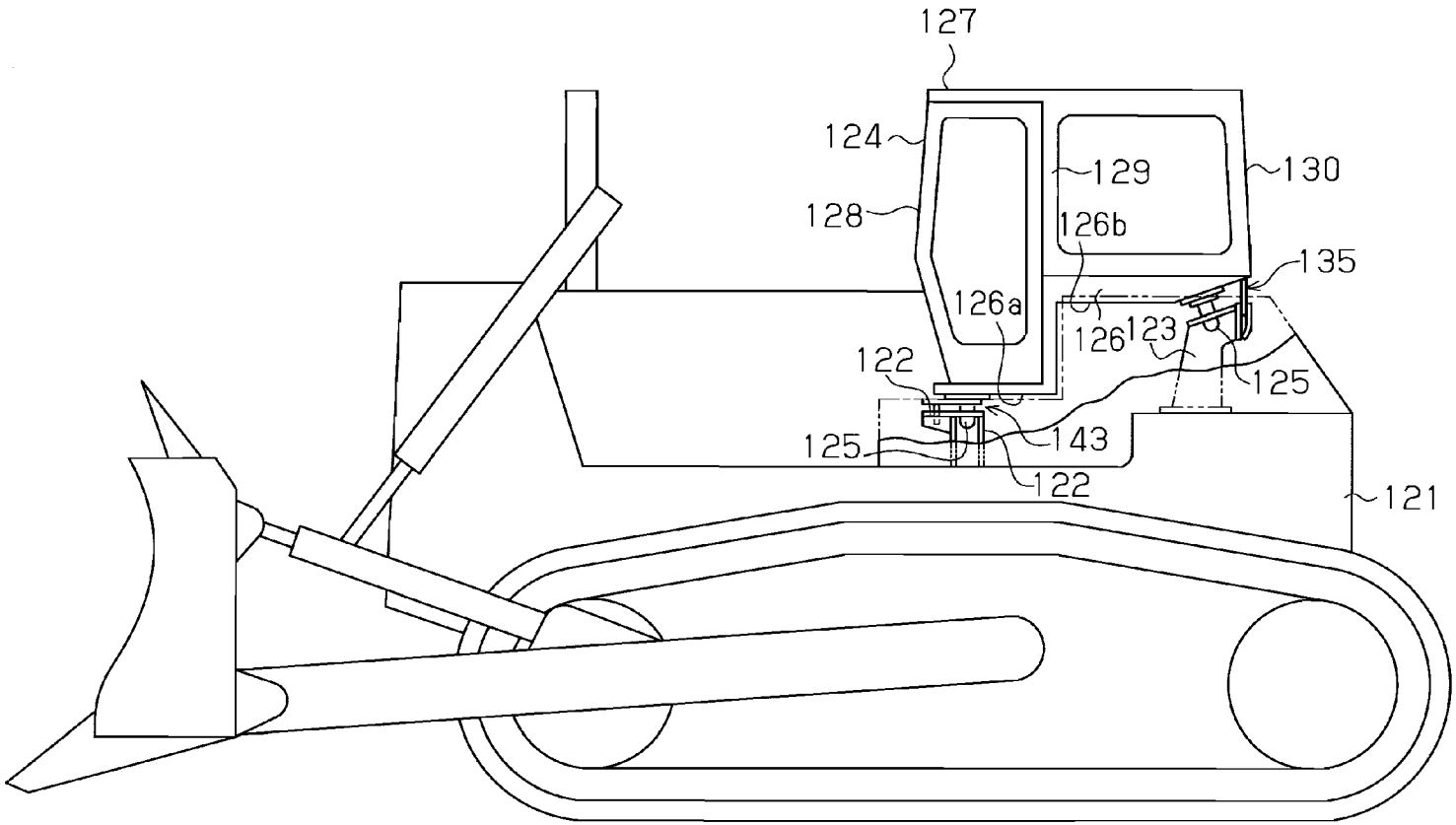
FIG. 14 is a side view showing a work machine in accordance with a sixth embodiment.

In this sixth embodiment, as shown in FIG. 14, pairs of front and rear supporting brackets 122 and 123 are arranged on a vehicle body frame 121 so as to have a height difference. A cab frame 124 is supported with a damper 125 on each of the supporting brackets 122 and 123. The cab frame 124 is provided with a floor portion 126 and a ceiling portion 127 in the same manner as the first embodiment. Pairs of right and left front pillars 128, intermediate pillars 129 and rear pillars 130 are arranged between the floor portion 126 and the ceiling portion 127. Further, the floor portion 126 of the cab frame 124 is arranged so as to have a height difference in the front-rear direction, the front portion forms a lower portion 126*a* and the rear portion forms a higher portion 126*b*.

Figure 17:
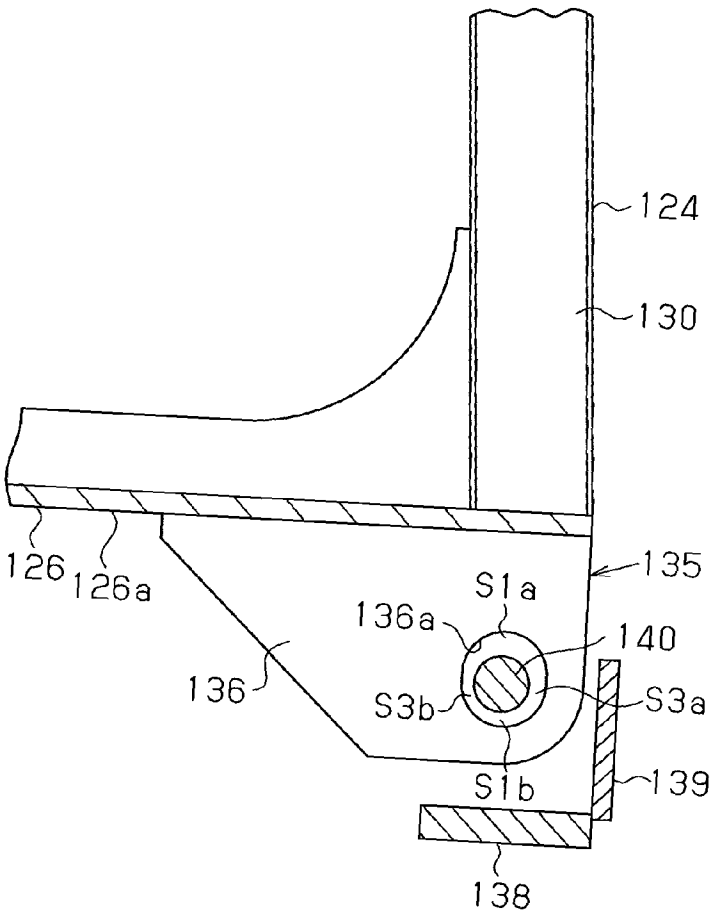
FIG. 17 is a partly cross-sectional view taken along line 17-17 in FIG. 16.
Figure 16:
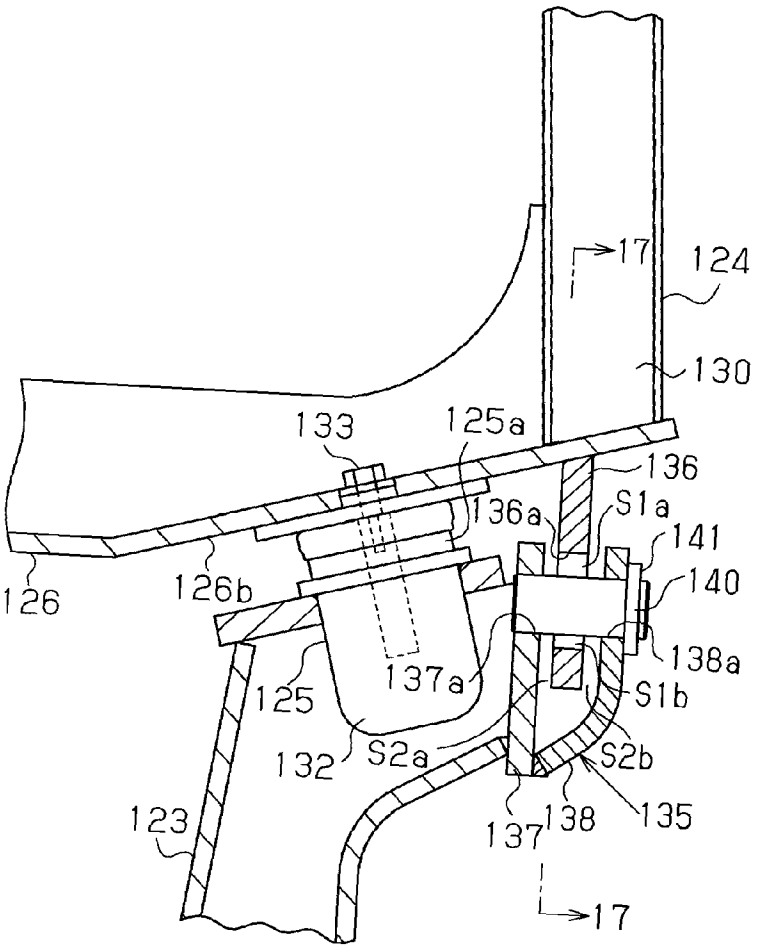
FIG. 16 is a partially cross-sectional view showing a lower rear portion of the cab frame in FIG. 14.

As shown in FIGS. 14, 16 and 17, a pair of right and left rear limiting mechanisms 135 are provided between each of the rear supporting brackets 123 on the vehicle body frame 121, and both right and left end portions of the higher portion 126*b* in the floor portion 126 of the cab frame 124. The rear limiting mechanisms 135 are arranged in such a manner as to be positioned substantially immediately below each of the rear pillars 130 of the cab frame 124. Further, when the excessive load is applied to the cab frame 124 in the case that the crawler dozer rolls over by any chance or the like, the movements in the vertical direction, the front-rear direction and the lateral direction of the cab frame 124 are limited within the predetermined range, by the rear limiting mechanism 135, in the rear portion of the cab frame 124 having a high sharing rate of the excessive load.

The rear limiting mechanism 135 is structured as follows. As shown in FIGS. 16 and 17, a limitation member 136 constituted by a metal plate is fixed to a lower surface of the higher portion 126*b* of the floor portion 126 in a suspended state, and a through hole 136*a* is formed in the limitation member 136, immediately below the rear pillar 130 of the cab frame 124. A pair of limiting members 137 and 138 constituted by a metal plate are fixed to an upper end rear portion of the rear supporting bracket 123 on the vehicle body frame 121 in parallel so as to be spaced at a predetermined interval in the front-rear direction in a vertical state, in such a manner as to be arranged to oppose to the front surface and the rear surface of the limitation member 136. Pin insertion holes 137*a* and 138*a* are formed in the limiting members 137 and 138. A closure plate 139 is arranged in an outer portion between both limiting members 137 and 138.

A metal limiting pin 140 is fitted to the pin insertion holes 137*a* and 138*a* of both of the limiting members 137 and 138 in such a manner as to extend in the front-rear direction, and an intermediate portion of the limiting pin 140 is inserted to the through hole 136*a* of the limitation member 136. A check plate 141 is fixed to a distal end portion of the limiting pin 140. Further, a bolt 142 extending through a hole 141*a* of the check plate 141 is engaged with a threaded hole 138*b* of the rear limiting member 138. On the basis of this engagement, the limiting pin 140 is held so as to be prevented from coming off from the pin insertion holes 137*a* and 138*a* of the limiting members 137 and 138.

Further, gaps S1*a* and S1*b* are respectively formed in an upper portion and a lower portion of a space between an outer peripheral surface of the limiting pin 140 and an inner peripheral surface of the through hole 136*a* of the limitation member 136. A movement in the vertical direction of the cab frame 124 is limited within the range of the gaps S1*a* and S1*b*. Further, gaps S2*a* and S2*b* are respectively formed between the limitation member 136, and the front limiting member 137 and the rear limiting member 138. A movement in the front-rear direction of the cab frame 124 is limited within the range of the gaps S2*a* and S2*b*. Further, gaps S3*a* and S3*b* are respectively formed in a left portion and a right portion between the outer peripheral surface of the limiting pin 140 and the inner peripheral surface of the through hole 136*a* of the limitation member 136. A movement in the lateral direction of the cab frame 124 is limited within the range of the gaps S3*a* and S3*b*.

Figure 15:
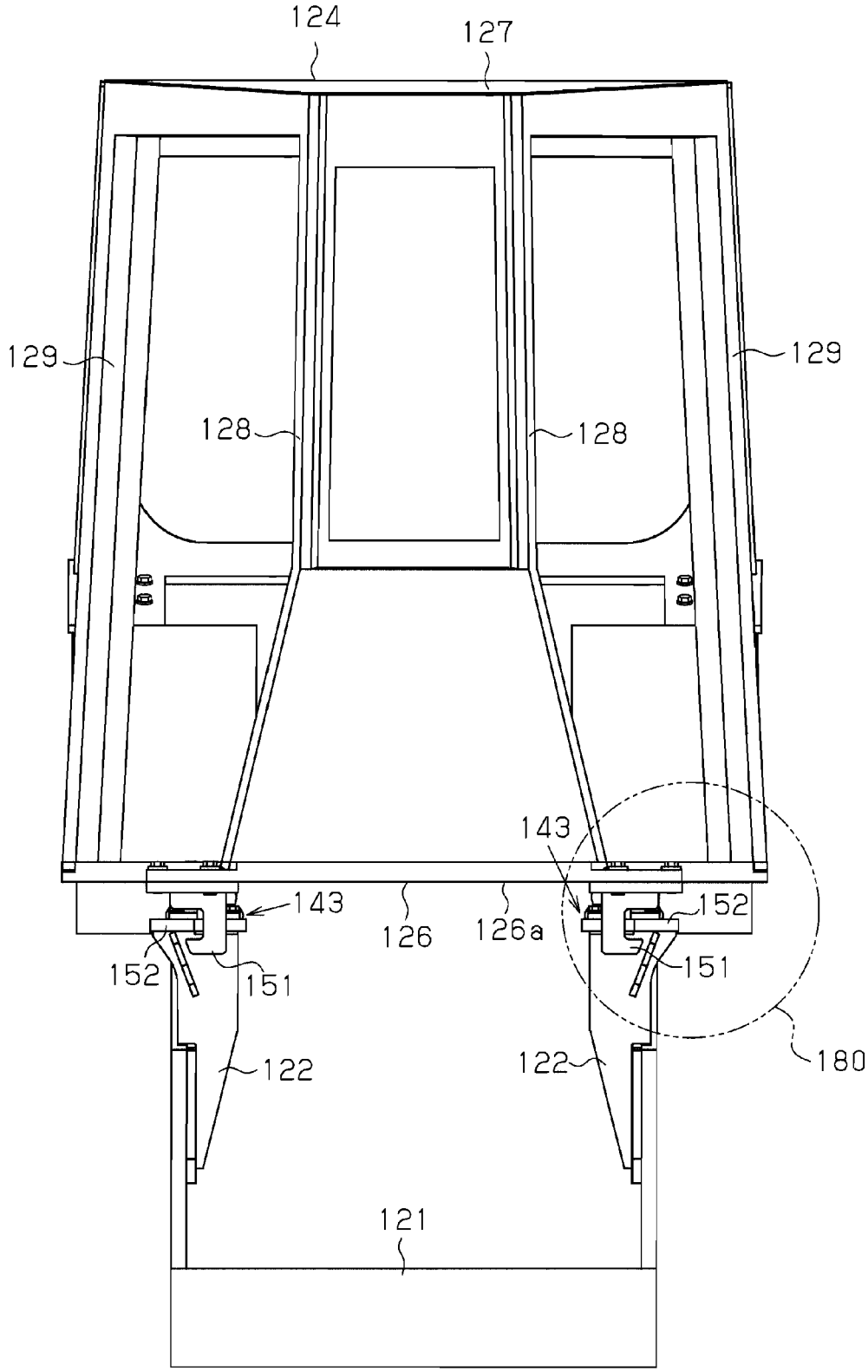
FIG. 15 is a front view of a supported state of the cab frame.
Figures 18A, 18B:
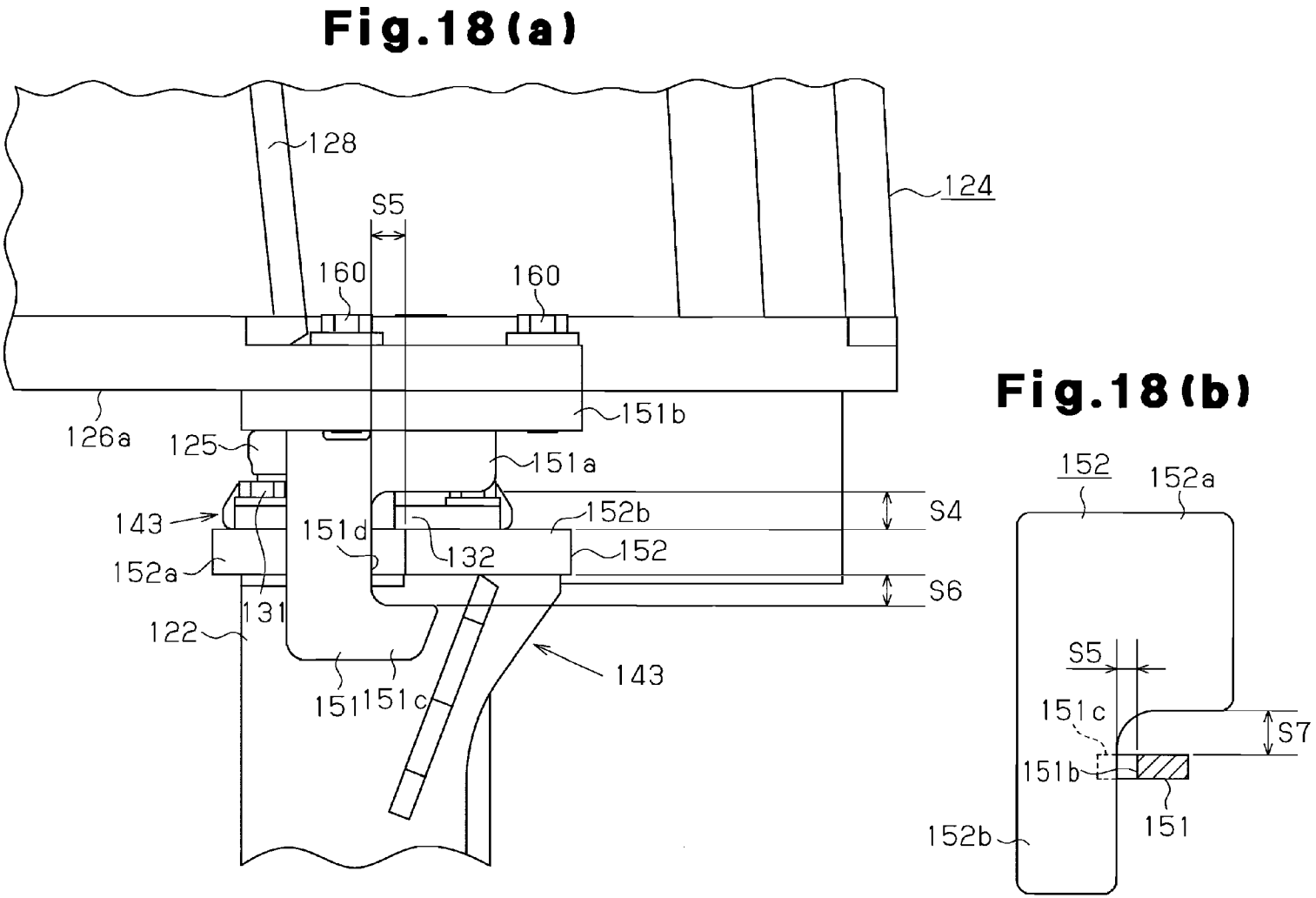
FIG. 18(*a*) is an enlarged front view of a portion of circle 180 in FIG. 15.
Figure 19:
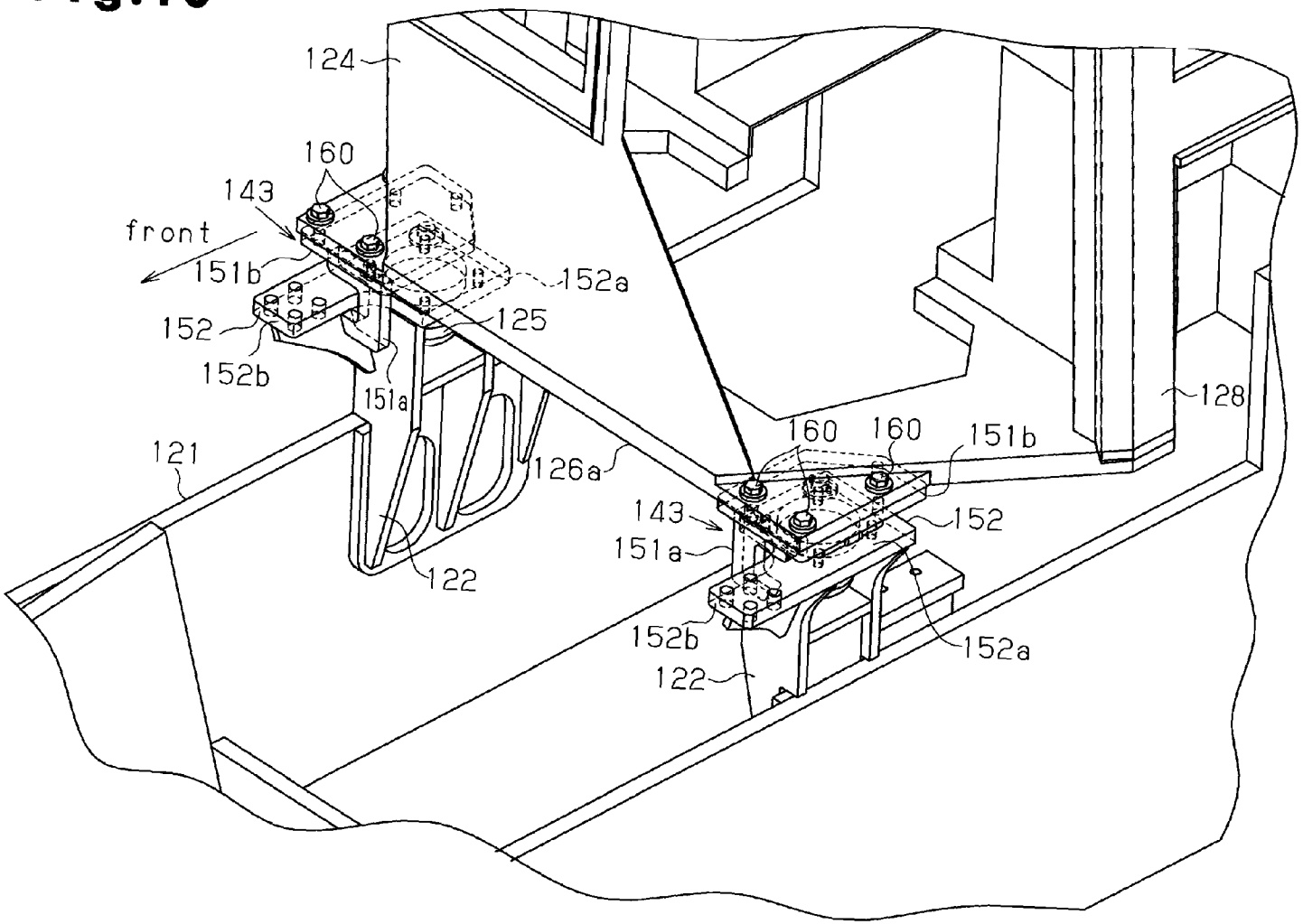
FIG. 19 is a perspective view showing a front limiting mechanism.

On the other hand, as shown in FIGS. 15, 18 and 19, a pair of front limiting mechanisms 143 serving as limiting means are provided between each of the front supporting brackets 122 on the vehicle body frame 121, and both right and left end portions of the lower portion 126*a* in the floor portion 126 of the cab frame 124. Further, when the excessive load is applied to the cab frame 124 in the case that the crawler dozer rolls over by any chance or the like, the movement in the vertical direction of the cab frame 124 is limited within the predetermined range by the front limiting mechanism 143, in the front portion of the cab frame 124 having a low sharing rate of the excessive load.

In other words, the front limiting mechanism 143 includes a first limiting plate 151 and a second limiting plate 152. The first limiting plate 151 includes an upper plate 151*b* having a flat plate shape, and a flat plate 151*a*, which is vertically welded to a flat plate surface of the upper plate 151*b* and extends downward. The flat plate 151*a* is formed as a hook shape as a whole by a recess 151*d* formed in the flat plate 151*a*. Further, the first limiting plate 151 is firmly attached to a lower surface of the lower portion 126*a* of the cab frame 124 in the upper plate 151*b* by a bolt 160 in such as manner that the recess 151*d* is open outward (toward the right side in FIG. 16) of the lateral direction of the work machine.

The second limiting plate 152 serving as the lower plate is substantially L-shaped as viewed from above, a proximal end portion 152*a* thereof is fixed onto the front supporting bracket 122 by a bolt 131 fixing the damper 125, and a free end portion 152*b* protrudes forward from a lower portion of the cab frame 124 through the inside of the recess 151*d* of the first limiting plate 151.

Further, as shown in FIG. 18(*a*), a gap S4 is formed between an upper side of the recess 151*d* of the second limiting plate 152 and an upper surface of the second limiting plate 152. A gap S5 is formed between an uprising side of the recess 151*d* and an end edge of the free end portion 152*b* of the second limiting plate 152. A gap S6 is formed between a lower side of the recess 151*d* and a lower surface of the second limiting plate 152. Further, as shown in FIG. 18(*b*), a gap S7 is formed between a rear surface of the flat plate 151*a* of the first limiting plate 151 and a front end surface of the proximal end portion 152*a* of the second limiting plate 152. Further, the movement in the vertical direction, the lateral direction and the backward direction of the cab frame 124 is limited within the range of the gaps S4 to S7.

Accordingly, in the sixth embodiment, both right and left end portions of the lower portion 126*a* of the cab frame 124 are in a state in which the limitation of the moving range in the forward direction is cancelled.

When an excessive load is applied to the cab frame 124 in the case that the crawler dozer rolls over by any chance or the like, at a time when the crawler dozer in accordance with the embodiment travels, the excessive load is shared and received by the rear limiting mechanism 135 and the front limiting mechanism 143. In other words, since the sharing rate of the excessive load is high in the rear portion of the cab frame 124 in comparison with the front portion, the rear portion is going to be moved and displaced largely in the vertical direction, the front-rear direction and the lateral direction. However, the movement and displacement of the rear portion is limited within the predetermined range in all the vertical, front-rear and lateral directions by the rear limiting mechanism 135. In contrast, in the front portion of the cab frame 124, the sharing rate of the excessive load is low, and the load in the vertical direction is slightly applied. Further, the movement and displacement in the vertical direction of the front portion is limited within the predetermined range by the front limiting mechanism 143. Accordingly, it is possible to bear the excessive load applied to the cab frame 124, and it is possible to protect the operator within the cab.

Further, in this embodiment, it is not necessary to set limiting mechanisms having the complicated structure for limiting the movement in all the vertical, front-rear and lateral directions in all of four positions corresponding to both right and left end portions of the higher portion 126*b* and the lower portion 126*a* of the cab frame 124. In other words, only the front limiting mechanism 143 having the simple structure and constituted by the first limiting plate 151 and the second limiting plate 152 are provided at two positions close to the lower portion 126*a* of the cab frame 124. Accordingly, it is possible to reduce the manufacturing costs, and it is possible to simplify the structure as a whole of the cab supporting apparatus.

Further, it is possible to limit the moving range of the rear portion having the high sharing rate of the excessive load within the predetermined range in all the vertical, front-rear and lateral directions of the cab frame 124 by the rear limiting mechanism 135, at a time when the crawler dozer rolls over or the like. Accordingly, even if the structure is made such that the movement limitation in all the vertical, front-rear and lateral directions of the cab frame 124 is executed only by the rear portion of the cab frame 124, it is possible to effectively bear the excessive load applied to the cab frame 124.

Further, in this case, the rear limiting mechanism 135 is arranged immediately below the rear pillar 130 of the cab frame 124. In this case, a major part of the excessive load applied to the rear portion of the cab frame 124 at the high sharing rate is supported by the rear pillar 130 of the cab frame 124. Accordingly, it is possible to reliably bear the excessive load, by arranging the rear limiting mechanism 135 immediately below the rear pillar 130 of the cab frame 124.

Further, the front limiting mechanism 143 limiting the moving range in the vertical direction of the cab frame 124 is provided between the lower portion 126*a* of the cab frame 124 to which the excessive load in the vertical direction tends to be applied in spite that the sharing rate with respect to the excessive load is low, and the vehicle body frame 121. Accordingly, it is possible to effectively bear the excessive load, even in a portion of the cab frame 124 that corresponds to the lower portion 126*a*.

Modified Embodiments

The embodiments may be modified as follows.

In the third embodiment shown in FIG. 11, it is possible to omit the lower limiting portion 31, the upper limiting portion 32, the hook portions 31*c* and 32*c* as necessary, in the same manner as the second embodiment and the fourth embodiment.

In the structure of the fifth embodiment shown in FIG. 13, it is possible to employ the structures of the second to fourth embodiments. In other words, in the fifth embodiment, it is possible to omit the hook portions 31*c* and 32*c* of the lower limiting portion 31 or the upper limiting portion 32 in the front portion or the rear portion. Alternatively, it is possible to omit the lower limiting portion 31 and the upper limiting portion 32 in the front portion or the rear portion.

In addition, it is possible to change the structures of the lower limiting portion and the upper limiting portion as necessary. In short, the structure may be made such that at least a pair of movement limiting mechanisms are provided between the vehicle body frame and the cab frame, thereby limiting the position of the cab frame at least in the vertical direction.

In the first to fifth embodiments, the lower limiting portion 31 and the upper limiting portion 32 are integrally formed with the lower plates 12*b* and 13*b* and the upper plate 25. However, it is possible to form the lower limiting portion 31 and the upper limiting portion 32 independently from the lower plate 12*b* and 13*b* and the upper plate 25 so as to fix to the lower plates 12*b* and 13*b* and the upper plate 25 by welding, a bolt or the like.

Figure 20:
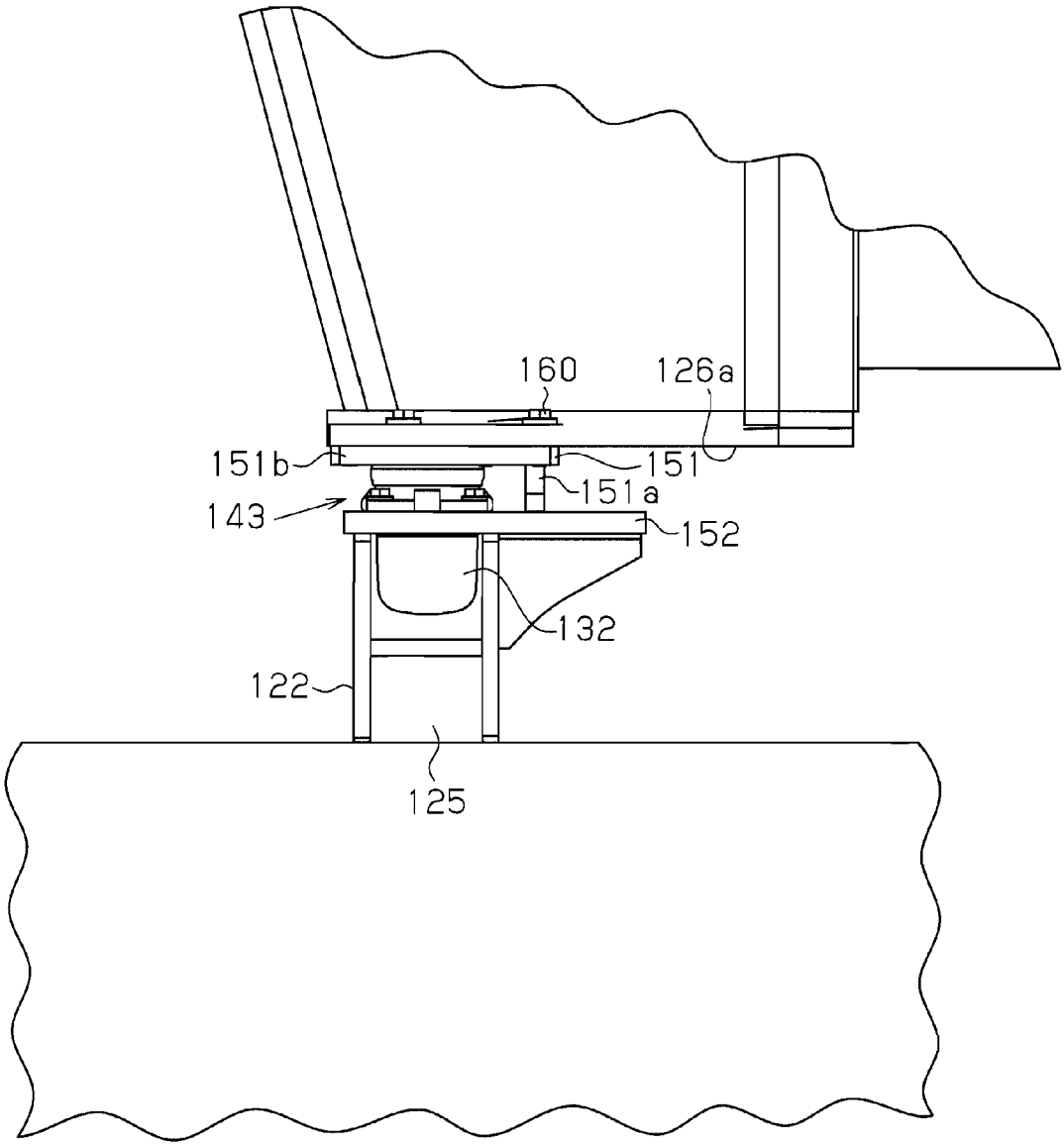
FIG. 20 is a partially side view showing a modified embodiment.
Figure 21:
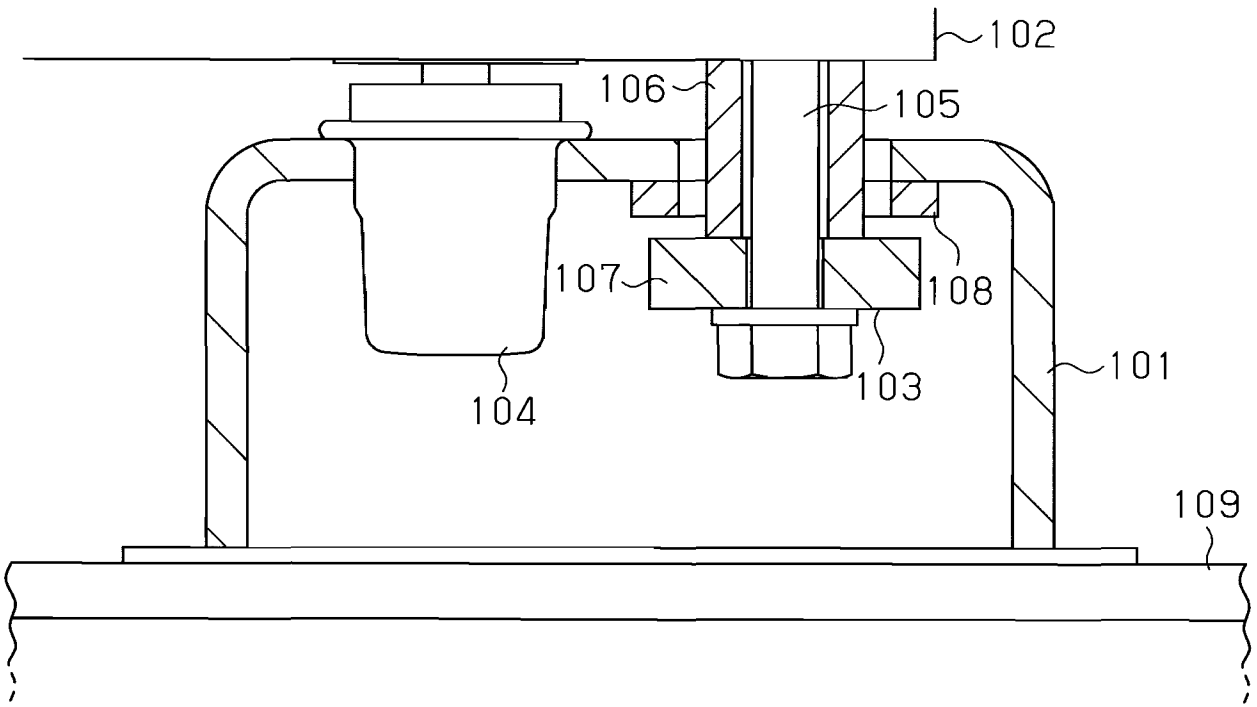
FIG. 21 is a cross-sectional view showing a conventional cab supporting apparatus.

In the sixth embodiment, it is possible to employ a structure which limits and cancels a moving range in a rearward direction or both right and left directions, in addition to the moving range limitation and cancellation of the moving range limitation in the forward direction of the cab frame 124, in the front limiting mechanism 143. For example, as shown in FIG. 20, it is possible to invert the backward and forward directions of the first limiting plate 151 and the second limiting plate 152 in the front limiting mechanism 143, thereby canceling the limitation of the moving range in the backward direction of the cab frame 124.

It is possible to embody the invention in work machines other than a crawler dozer, for example, a hydraulic excavator, a crawler or wheel loader, a motorized grader or the like.

What is claimed is:

1. A cab supporting apparatus of a work machine in which a cab frame is supported on brackets provided at a plurality of positions of a vehicle body frame with vibration proofing mount means, the cab supporting apparatus comprising:

limiting means for limiting a movement at least in a vertical direction of the cab frame is provided between the brackets and the cab frame, wherein the limiting means is provided at least at two positions, the limiting means includes lower limiting portions close to the brackets, and upper limiting portions close to the cab frame, and each lower limiting portion is integrally structured with one of the bracket, and wherein each of the lower limiting portions forms a recess which opens inwardly, and a hook portion is formed in a distal end of each of the lower limiting portions on the basis of the formation of the recess, wherein each of the upper limiting portions forms a recess which opens outwardly, and a hook portion is formed in a distal end of each of the upper limiting portions on the basis of the formation of the recess, wherein, in a state in which the recess of each of the lower limiting portions opposes the recess of each of the upper limiting portions, the lower limiting portion and the upper limiting portion are respectively positioned within the corresponding recesses, and the hook portions respectively oppose an outer surface of the upper limiting portion and a lower surface of the lower limiting portion, wherein a first gap is formed between an upper surface of the lower limiting portion and an upper edge portion of the recess of the upper limiting portion, wherein a second gap is formed between a lower surface of the lower limiting portion and a lower edge portion of the recess of the upper limiting portion, wherein a movement in the vertical direction of the cab frame is allowed with respect to the vehicle body frame, within the range of the first and second gaps.

2. The cab supporting apparatus according to claim 1, wherein an upper end of each bracket includes a plate member, and each lower limiting portion is integrally formed in one of the plate members.

3. The cab supporting apparatus according to claim 1, wherein a plate member is fixed to a bottom surface of the cab frame, and the upper limiting portions are integrally formed in the plate member.

4. The cab supporting apparatus according to claim 1, wherein a lower portion is provided in a front portion of a floor portion of the cab frame, a higher portion is provided in a rear portion, and the vibration proofing mount means is interposed between the brackets, and the lower and higher portions of the floor portion, wherein, in the limiting means between the vehicle body frame and both right and left end portions in the lower portion of the cab frame, the limitation in the moving range of the cab frame is cancelled at least in one direction other than the vertical direction.

5. A cab supporting apparatus of a work machine in which a cab frame is supported on brackets provided at a plurality of positions of a vehicle body frame with vibration proofing mount means, the cab supporting apparatus comprising:

limiting means for limiting a movement at least in a vertical direction of the cab frame is provided between the brackets and the cab frame, wherein the limiting means is provided at least at two positions, the limiting means includes lower limiting portions close to the brackets, and upper limiting portions close to the cab frame, and each lower limiting portion is integrally structured with one of the bracket, and wherein each of the lower limiting portions forms a recess which opens in one of a first and second directions, and a hook portion is formed in a distal end of each of the lower limiting portions on the basis of the formation of the recess, said first direction being inwardly in a lateral direction of the vehicle body frame and said second direction being outwardly in the lateral direction of the vehicle body frame, wherein each of the upper limiting portions forms a recess which opens in the other one of said first and second directions, and a hook portion is formed in a distal end of each of the upper limiting portions on the basis of the formation of the recess, wherein, in a state in which the recess of each of the lower limiting portions opposes the recess of each of the upper limiting portions, the lower limiting portion and the upper limiting portion are respectively positioned within the corresponding recesses, and the hook portions respectively oppose an outer surface of the upper limiting portion and a lower surface of the lower limiting portion, wherein a first gap is formed between an upper surface of the lower limiting portion and an upper edge portion of the recess of the upper limiting portion, wherein a second gap is formed between a lower surface of the lower limiting portion and a lower edge portion of the recess of the upper limiting portion, wherein a movement in the vertical direction of the cab frame is allowed with respect to the vehicle body frame, within the range of the first and second gaps.

6. The cab supporting apparatus according to claim 5, wherein an upper end of each bracket includes a plate member, and each lower limiting portion is integrally formed in one of the plate members.

7. The cab supporting apparatus according to claim 5, wherein a plate member is fixed to a bottom surface of the cab frame, and the upper limiting portions are integrally formed in the plate member.

8. The cab supporting apparatus according to claim 5, wherein a lower portion is provided in a front portion of a floor portion of the cab frame, a higher portion is provided in a rear portion, and the vibration proofing mount means is interposed between the brackets, and the lower and higher portions of the floor portion, wherein, in the limiting means between the vehicle body frame and both right and left end portions in the lower portion of the cab frame, the limitation in the moving range of the cab frame is cancelled at least in one direction other than the vertical direction.

9. The cab supporting apparatus according to claim 5, further comprising a gap extending in a direction other than the vertical direction between the lower limiting portions and the upper limiting portions so as to allow movement of the cab frame in said other direction within the range of said other direction gap with respect to the body frame.

* * * * *